US009104148B2

(12) United States Patent
Hasegawa

(10) Patent No.: US 9,104,148 B2
(45) Date of Patent: Aug. 11, 2015

(54) IMAGE HEATING APPARATUS AND IMAGE FORMING APPARATUS

(71) Applicant: CANON KABUSHIKI KAISHA, Tokyo (JP)

(72) Inventor: Takuya Hasegawa, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 13/755,723

(22) Filed: Jan. 31, 2013

(65) Prior Publication Data

US 2013/0209145 A1 Aug. 15, 2013

(30) Foreign Application Priority Data

Feb. 14, 2012 (JP) ..... 2012-029191

(51) Int. Cl.
*G03G 15/20* (2006.01)

(52) U.S. Cl.
CPC .... *G03G 15/2053* (2013.01); *G03G 2215/2019* (2013.01)

(58) Field of Classification Search
CPC ..... G03G 15/2019; G03G 15/2053
USPC ..... 399/67, 69, 328
See application file for complete search history.

(56) References Cited

U.S. PATENT DOCUMENTS

| | | | | |
|---|---|---|---|---|
| 7,391,983 | B2 | 6/2008 | Tatematsu et al. | |
| 7,430,394 | B2 | 9/2008 | Fujimori et al. | |
| 7,570,909 | B2 | 8/2009 | Asakura et al. | |
| 7,711,306 | B2 | 5/2010 | Kagawa | |
| 7,751,730 | B2 | 7/2010 | Kato et al. | |
| 7,761,045 | B2 | 7/2010 | Fujimori et al. | |
| 7,844,207 | B2 | 11/2010 | Ryo et al. | |
| 2007/0189817 | A1 | 8/2007 | Kagawa | |
| 2007/0248389 | A1* | 10/2007 | Asakura et al. | 399/328 |
| 2008/0003029 | A1 | 1/2008 | Fujimori et al. | |
| 2008/0317526 | A1* | 12/2008 | Fujimori et al. | 399/329 |
| 2009/0114510 | A1* | 5/2009 | Chiba | 399/328 |
| 2009/0257761 | A1 | 10/2009 | Kato et al. | |

(Continued)

FOREIGN PATENT DOCUMENTS

| | | | |
|---|---|---|---|
| CN | 101059677 | A | 10/2007 |
| CN | 101101475 | A | 1/2008 |

(Continued)

OTHER PUBLICATIONS

Russian Office Action dated Aug. 25, 2014, issued in counterpart Russian Application No. 2013106358/28(009433), and English-language translation thereof.

(Continued)

*Primary Examiner* — Ryan Walsh
(74) *Attorney, Agent, or Firm* — Fitzpatrick, Cella, Harper & Scinto

(57) ABSTRACT

An image heating apparatus includes a rotatable heating member configured to heat a toner image on a sheet; a belt unit including an endless belt configured to heat the rotatable heating member by contacting an outer surface of the rotatable heating member, and a supporting mechanism configured to rotatably supporting the endless belt; a detector configured to detect that the endless belt is out of a predetermined zone in a widthwise direction of the endless belt; and a tilting mechanism configured to tilt the belt unit in a direction of causing the endless belt to return into the predetermined zone based on an output of the detector.

45 Claims, 16 Drawing Sheets

(56) References Cited

U.S. PATENT DOCUMENTS

| | | | | |
|---|---|---|---|---|
| 2010/0296828 | A1* | 11/2010 | Hara et al. | 399/69 |
| 2013/0051875 | A1* | 2/2013 | Takahashi | 399/329 |
| 2014/0226998 | A1* | 8/2014 | Hasegawa | 399/67 |

FOREIGN PATENT DOCUMENTS

| | | | |
|---|---|---|---|
| JP | 9-309642 | | 12/1997 |
| JP | 2007-212896 | A | 8/2007 |
| JP | 2007-292891 | | 11/2007 |
| JP | 2008-33227 | | 2/2008 |
| RU | 2390813 | C2 | 5/2010 |

OTHER PUBLICATIONS

Chinese Office Action and Search Report dated Feb. 15, 2015, in Chinese Application No. 201310050039.X.

Apr. 21, 2015 Office Action in counterpart Korean Patent Application No. 10-2014-7003127.

Apr. 3, 2015 Office Action in counterpart Russian Patent Application No. 2013106358/28.

* cited by examiner

| EMBODIMENTS | EMB. 1 | | | EMB. 2 | | | EMB. 3 | | |
|---|---|---|---|---|---|---|---|---|---|
| ROTATION CENTERS OF EXT. HEAT UNITS | END | | | CENTER | | | CENTER | | |
| OUTER SHAPES OF SUPPORTING ROLLER | STRAIGHT | | | STRAIGHT | | | REVERSE CROWN | | |
| COMPARISONS REL. TO CENTER PRESS. | FRONT | CENTER | REAR | FRONT | CENTER | REAR | FRONT | CENTER | REAR |
| LOWEST TEMPS. OF FIXING ROLLERS | 166.8 ℃ | 167.9 ℃ | 170.2 ℃ | 168.0 ℃ | 168.5 ℃ | 168.0 ℃ | 168.3 ℃ | 168.3 ℃ | 168.3 ℃ |

Fig. 16

IMAGE HEATING APPARATUS AND IMAGE FORMING APPARATUS

FIELD OF THE INVENTION AND RELATED ART

The present invention relates to an image forming apparatus, such as a printer, a copying machine, a facsimile machine, and the like, which employs an electrophotographic image forming method or an electrostatic recording method. It relates to also an electrophotographic multifunction image forming apparatus and an electrostatic multifunction image recording apparatus which are capable of playing two or more roles of the abovementioned examples of image forming apparatus. Further, it relates to an image heating apparatus employable by an image forming apparatus such as the abovementioned ones.

There have been known various types of image forming apparatuses. However, it is electrophotographic image forming apparatuses that are widely in current use. An image forming apparatus is desired to be high in productivity regardless of recording medium type. That is, not only is it desired to be high in productivity (in terms of number of prints per unit length of time) when recording medium is ordinary or thin paper, but also, when recording medium is cardstock or the like.

In order for an image forming apparatus such as those mentioned above to be high in productivity even when recording medium is cardstock or the like, that is, recording medium which is significantly greater in basis weight, it has to employ a fixing device (image heating device) which is high in fixation speed. However, the amount by which a fixing device is robbed of heat by recording medium when cardstock or the like is used as recording medium is substantially greater than that when thin paper or the like is used as recording medium. In other words, the amount of heat required of a fixing device for image fixation when cardstock or the like is used as recording medium is substantially greater than that when thin paper or the like is used as recording medium. One of the known methods to deal with cardstock or the like is to reduce a fixing device (hence, image forming apparatus) in productivity (fixation speed; number of prints per unit length of time).

Thus, there have been devised various methods for dealing with cardstock or the like without reducing a fixing device (image heating device) in productivity. One of them is disclosed in Japanese Laid-open Patent Application 2007-212896. According to this patent application, a fixing device is provided with an external heating means which is placeable in contact with the peripheral surface of the fixation roller of the fixing device to keep the temperature of the peripheral surface of the fixation roller at a preset target level. More specifically, in order to substantially improve a fixing device in terms of its ability to keep the fixation roller stable in surface temperature at a preset level, the fixing device is provided with an external heating belt (endless belt), instead of an external heating roller, because an external heating belt is substantially greater in the area of contact between the external heating means and fixation roller than an external heating roller. The external heating belt (endless belt) is suspended (supported) by a pair of belt supporting rollers in such a manner that it can be circularly movable in contact with the peripheral surface of the fixation roller to externally heat the fixation roller.

However, unless it is ensured that the two belt supporting rollers remain perfectly parallel to each other, the external heating belt is made to shift in its widthwise direction, making it possible for the belt to become unstable in its movement. Yet, it is virtually impossible to construct a fixing device so precisely that a pair of its endless belt supporting rollers remain perfectly parallel to each other. One of the possible solutions to this problem is to structure a fixing device so that one of the pair of belt supporting rollers can be tilted relative to the other to control the external heating belt in positional deviation. This solution, however, is difficult to adopt, because the external heating belt is required to heat the fixation roller. More specifically, in the case of this method, that is, in the case where a fixing device is structured so that one of the belt supporting rollers can be tilted relative to the other, pivotally moving one of the belt supporting roller relative to the other possibly causes the heating range of the heating belt to partially disengage from the fixation roller, which in turn reduces the heating belt in performance. With the heating belt reduced in performance, the fixing device is likely to fail to properly fix an unfixed toner image.

SUMMARY OF THE INVENTION

Thus, one of the primary objects of the present invention is to provide an image heating apparatus (device) which is superior to any image heating apparatus in accordance with the prior art, in terms of the stability of endless belt movement.

Another object of the present invention is to provide an image forming apparatus which is superior to any image forming apparatus in accordance with the prior art, in terms of the stability of endless belt movement.

According to an aspect of the present invention, there is provided, for example, an image heating apparatus comprising a rotatable heating member configured to heat a toner image on a sheet; a belt unit including an endless belt configured to heat said rotatable heating member by contacting an outer surface of said rotatable heating member, and a supporting mechanism configured to rotatably supporting said endless belt; a detector configured to detect that said endless belt is out of a predetermined zone in a widthwise direction of said endless belt; and a tilting mechanism configured to tilt said belt unit in a direction of causing said endless belt to return into the predetermined zone based on an output of said detector.

According to another aspect of the present invention, there is provided, for example, an image forming apparatus comprising a belt unit including an endless belt and a supporting roller rotatably supporting said endless belt at an inner surface of said endless belt; a driving rotatable member contacted to an outer surface of the endless belt to rotate said endless belt; a detector configured to detect a position of said endless belt in a widthwise direction of said endless belt; and a tilting mechanism configured to tilt, in accordance with an output of the detector, said belt unit so that an axis of the supporting roller which press-contacts said endless belt to said heating rotatable member crosses with a generatrix of the heating rotatable member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 16 is a table which shows the results of the experiment carried out for comparing the effects of the first, second, and third embodiment of the present invention.

DESCRIPTION OF THE PREFERRED EMBODIMENTS

Hereinafter, embodiments of the present invention are described in detail with reference to the appended drawings. Incidentally, in the description of the following embodiments of the present invention, an image heating apparatus in accordance with the present invention is described as a fixing device for fixing an unfixed toner image to a sheet of recording medium (paper). However, the present invention is also applicable to an image heating device (apparatus) for applying heat and pressure to the fixed or semi-fixed image on a sheet of recording medium in order to modify the toner image in surface properties.

Embodiment 1

To begin with, an image forming apparatus 100, which is compatible with the present invention, is described with reference to FIG. 2, which is a schematic sectional view of the image forming apparatus 100 having an image heating device which functions as a fixing device. This image forming apparatus 100 is a color laser beam printer of the so-called tandem type, which has the first, second, third and fourth image formation stations Pa, Pb, Pc and Pd, which are aligned in the listed order, in the moving direction of its intermediary transfer belt 130. Incidentally, FIG. 2 does not show a fixation roller heating external unit 34, which will be described later.

<Image Forming Apparatus>

Figure 2:
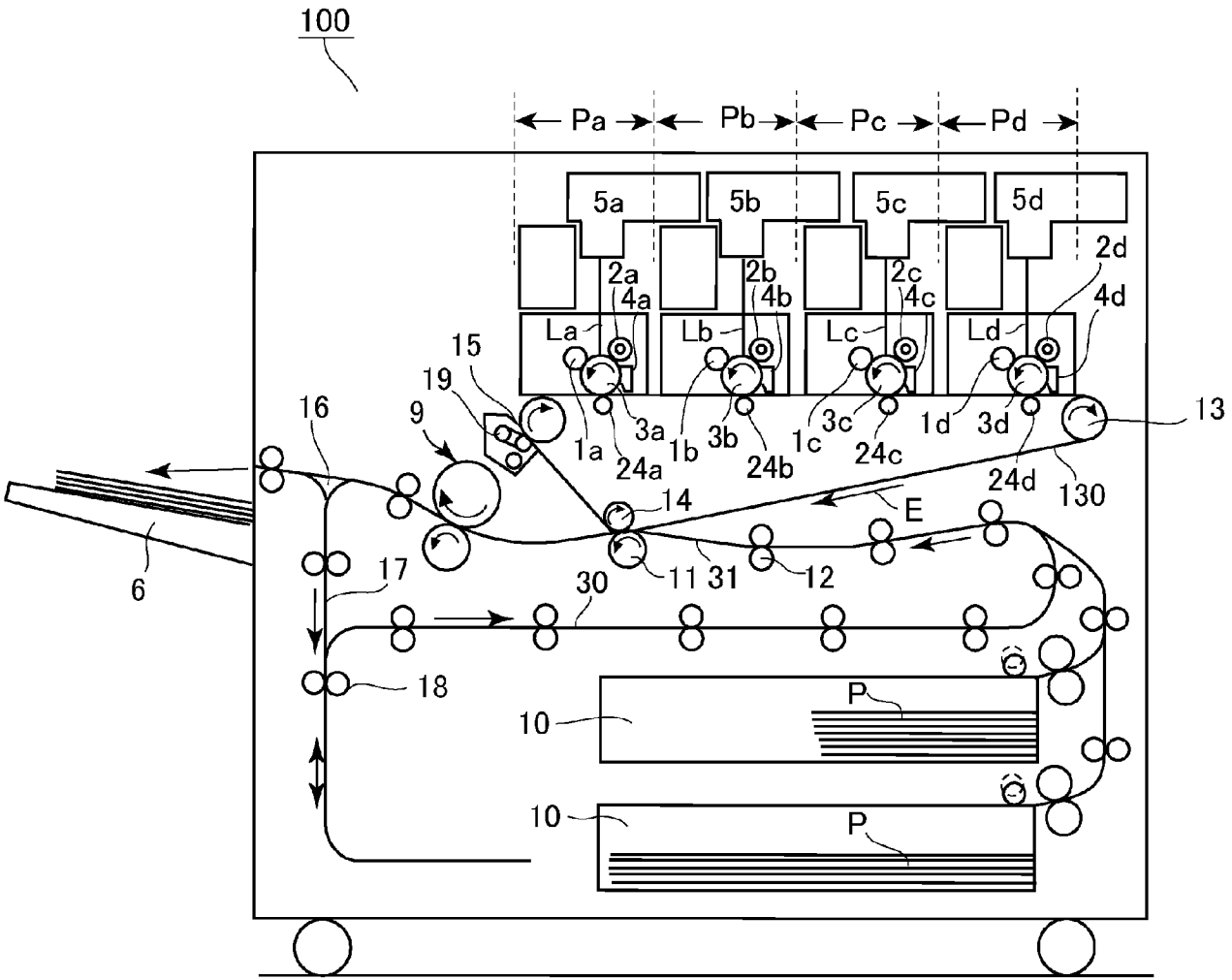
FIG. 2 is a schematic sectional view of an image forming apparatus which employs a fixing device in accordance with the present invention. It shows the general structure of the apparatus.

Referring to FIG. 2, the image forming apparatus 100 internally holds the first, second, third, and fourth image formation stations Pa, Pb, Pc and Pd which are aligned in tandem, and in which multiple (four) monochromatic toner images, different in color, are formed, one for one, sequentially through a process of forming a latent image, a process of developing the latent image, and a process of transferring the developed latent image. Each of these image formation stations Pa, Pb, Pc and Pd has its own electrophotographic photosensitive member (in this embodiment, photosensitive drums 3*a*, 3*b*, 3*c* and 3*d*), and forms a monochromatic toner image which is different in color from those formed in the other image formation stations.

The image forming apparatus 100 is provided with the intermediary transfer belt 130, which is positioned so that its outward surface contacts the peripheral surface of each of the photosensitive drums 3*a*, 3*b*, 3*c* and 3*d*. The toner images, different in color, formed on the peripheral surfaces of the photosensitive drums 3*a*, 3*b*, 3*c* and 3*d*, one for one, are transferred (primary transfer) onto the intermediary transfer belt 130, and then, are transferred (secondary transfer) onto a sheet P of recording medium, in the secondary transfer station. After the transfer of the toner images, different in color, onto the sheet P, the sheet P is conveyed to the fixing device 9, in which the toner images are fixed to the sheet P by the application of heat and pressure to the sheet P and toner images thereon. After the fixation of the toner images to the sheet P, the sheet P is discharged as a finished print from the image forming apparatus 100. A combination of the image formation stations Pa, Pb, Pc and Pd, and intermediary transfer belt 130 makes up an image forming unit. The abovementioned fixing device 9 is for fixing to the sheet P, the toner images formed on the sheet P by this image formation unit.

The image forming apparatus 100 is also provided with drum charging devices 2*a*, 2*b*, 2*c* and 2*d*, developing devices 1*a*, 1*b*, 1*c* and 1*d*, primary transfer charging devices 24*a*, 24*b*, 24*c* and 24*d*, and cleaners 4*a*, 4*b*, 4*c* and 4*d*, which are positioned in the adjacencies of the peripheral surface of the photosensitive drums 3*a*, 3*b*, 3*c* and 3*d*, respectively. The image forming apparatus 100 has also laser scanners 5*a*, 5*b*, 5*c* and 5*d*, which are in the top portion of the image forming apparatus 100.

Each of the laser scanners 5*a*, 5*b*, 5*c* and 5*d* internally holds unshown light source and a polygonal mirror. The beam of laser light emitted from the light source is deflected by the rotating polygonal mirror, deflected by a stationary mirror, and focused by the f-θ lens (unshown) onto the peripheral surfaces of the photosensitive drums 3*a*, 3*b*, 3*c* and 3*d*, so that the beam of laser light is made to scan (expose) the peripheral surface of the photosensitive drums 3*a*, 3*b*, 3*c* and 3*d*. Thus, a latent image which reflects image formation signals is formed on the peripheral surface of each of the photosensitive drums 3*a*, 3*b*, 3*c* and 3*d*.

The developing devices 1*a*, 1*b*, 1*c* and 1*d* contain a preset amount of cyan, magenta, yellow, and black toners, respectively, which are delivered thereto by an unshown toner delivering devices. The developing devices 1*a*, 1*b*, 1*c* and 1*d* develop the latent images on the photosensitive drums 3*a*, 3*b*, 3*c* and 3*d*, into visible images, that is, cyan, magenta, yellow and black toner images, respectively.

The intermediary transfer belt 130 is circularly driven in the direction indicated by an arrow mark E in FIG. 2, at the same speed as the peripheral velocity of each of the photosensitive drums 3*a*, 3*b*, 3*c* and 3*d*. While the cyan toner image, that is, the image formed on the photosensitive drum 3*a* in the first image formation station Pa, is conveyed through the nip between the photosensitive drum 3*a* and intermediary transfer belt 130, it is transferred onto the outward surface of the intermediary transfer belt 130, in terms of the loop which the intermediary transfer belt 130 forms, by a combination of the electric field formed by the primary transfer bias applied to the intermediary transfer belt 130, and the pressure in the nip.

Designated by a referential code 11 is a secondary transfer roller, which is supported by a pair of bearings, in parallel to the widthwise direction of the intermediary transfer belt 130 and in contact with the outward surface of the intermediary transfer belt 130. The secondary transfer roller 11 is kept pressed against a roller 14, which is one of the through rollers 13, 14 and 15, by which the intermediary transfer belt 130 is suspended and kept tensioned, with the placement of the intermediary transfer belt 130 between the secondary transfer roller 11 and roller 14. As it is kept pressed against the roller 14, it forms the secondary transfer nip between itself and roller 14. To the secondary transfer roller, a preset secondary transfer bias is applied by a secondary transfer bias power source.

After the formation of a synthetic full-color toner image by the transfer in layers of the magenta, yellow, and black toner images onto the intermediary transfer belt 130 in such a manner that they are layered on the cyan toner image on the intermediary transfer belt 130, the full-color toner image is transferred onto a sheet P of recording medium as follows. That is, the sheet P of recording medium is delivered to the nip between the intermediary transfer belt 130 and secondary transfer roller 11 from a sheet feeder cassette 10, through the pair of registration rollers 12 and a pre-transfer sheet guide (unshown). Then, it is conveyed through the nip while the secondary transfer bias is applied to the secondary transfer roller 11 from the secondary bias power source. Thus, the synthetic full-color image is transferred onto the sheet P from the intermediary transfer belt 130 by the secondary transfer bias.

Similarly, magenta, cyan and black toner images, that is, the toner images formed in the second, third, and fourth image formation stations Pb, Pc and Pd are transferred onto the intermediary transfer belt 130 in such a manner that they are layered on the cyan toner image on the intermediary transfer belt 130. Consequently, a synthetic full-color image, which is virtually identical to the original image, is formed. The synthetic multicolor toner image is formed in such a manner that as it is transferred onto a sheet P of recording medium, a preset amount of margin will be left along the edges of the sheet P.

After the primary transfer, the photosensitive drums 3*a*, 3*b*, 3*c* and 3*d* are cleaned by the cleaners 4*a*, 4*b*, 4*c* and 4*d*, respectively (toner remaining on peripheral surface of photosensitive drums 3*a*, 3*b*, 3*c* and 3*d* is removed by cleaners 4*a*, 4*b*, 4*c* and 4*d*), being thereby prepared for the subsequent formation of a latent image thereon. The toner remaining on the intermediary transfer belt 130 after the secondary transfer, and the like contaminants are wiped away by a cleaning web 19 (nonwoven cloth) which is placed in contact with the surface of the intermediary transfer belt 130.

After the second transfer, or the transfer of the multicolor toner image onto the sheet P of recording medium, the sheet P is introduced into the fixing device 9, in which the unfixed multicolor toner image is fixed to the sheet P by the heat and pressure applied thereto by the fixing device. When the image forming apparatus is in the two-sided printing mode, the sheet P of recording medium is fed from the sheet feeder cassette 10 into the main assembly of the apparatus 100, and conveyed further by the pair of registration rollers 12 and pre-transfer guide. Then, it is conveyed through the nip between the intermediary transfer belt 130 and secondary transfer roller 11, in which unfixed multicolor toner image is fixed to one the two surfaces of the sheet P (first surface). Then, the sheet P is conveyed out of the fixing device 9, and is guided into the sheet reversal passage 17 by the flapper 16 (sheet directing member).

Then, the sheet P is changed in direction, and guided into the two-sided printing passage 30, by a pair of sheet reversing rollers 18. Then, it is conveyed by the pair of registration rollers 12, guided by the pre-transfer guide, conveyed through the nip between the intermediary transfer belt 130 and secondary transfer roller 11, and conveyed through the fixing device 9, for the second time, in which the unfixed multicolor toner image on the second surface of the sheet P is fixed. While the second multicolor toner image is formed on the second surface of the sheet P, the flapper 16 (sheet directing member) is switched in position, so that after the fixation of the second image onto the second surface of the sheet P, the sheet P is discharged as a two-sided print from the image forming apparatus 100.

[Fixing Apparatus]

Figure 1:
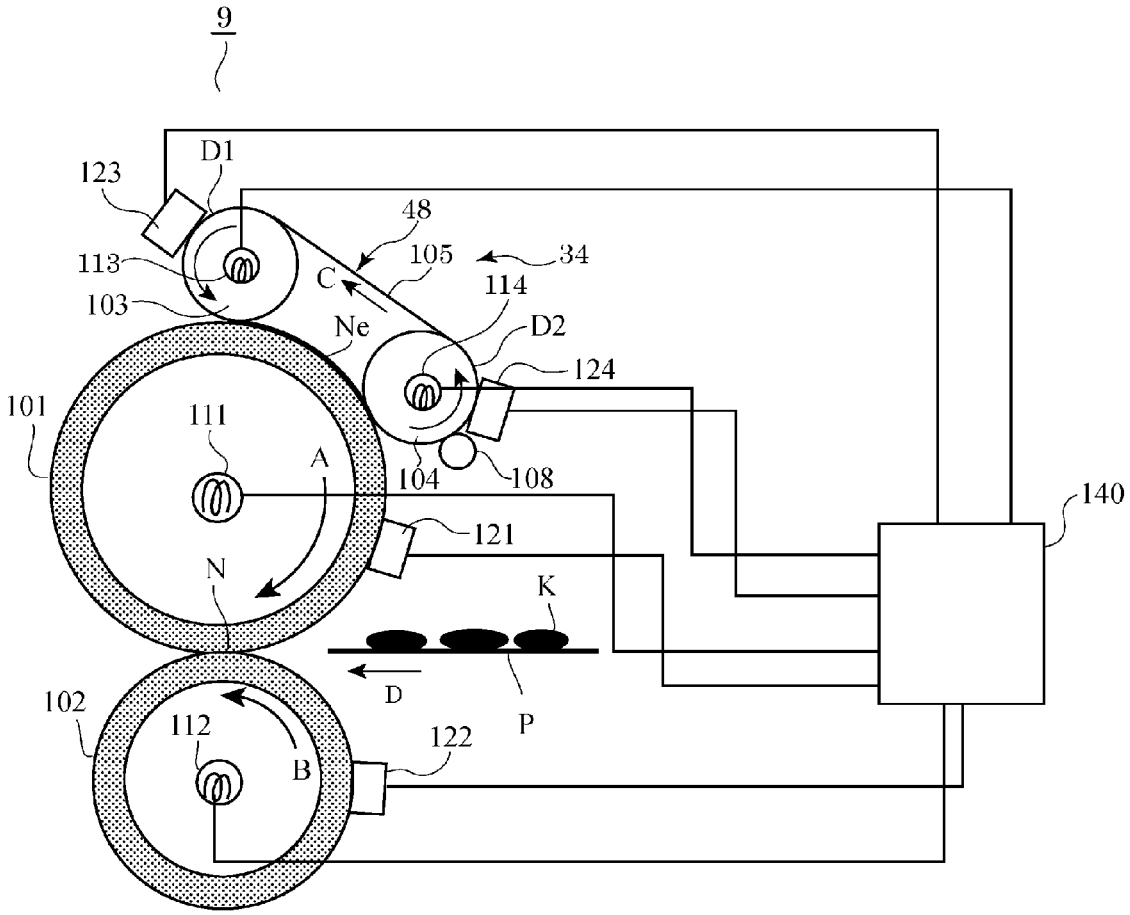
FIG. 1 is a schematic sectional view of a fixing device, in the first embodiment of the present invention, which has an external heating belt. It shows the general structure of the device.

Next, referring to FIG. 1, the fixing device 9, which functions as an image heating device, is described in detail. FIG. 1 is a schematic sectional view of the fixing device 9 in this embodiment, which is equipped with an endless belt for externally heating the fixation roller of the fixing device 9. It shows the general structure of the device 9. As described above, the image forming apparatus 100 is equipped with the fixing device 9, as an image heating device, which is in accordance with the present invention.

Referring to FIG. 2, the fixing device 9 has a function of heating the unfixed toner image K on the sheet P of recording medium, with its fixation roller 101, while the sheet P is conveyed through the fixation nip N. It has a fixation roller heating external unit 34, the fixation roller 101, the pressure roller 102, and an unshown external frame in which the preceding components are encased. The fixation roller heating external unit 34 has a holding unit 43 for holding the external heating unit 34.

More specifically, the fixing device 9 has: the fixation roller 101 as a rotational heating member (heat roller) for heating the image on the sheet P of recording medium; pressure roller 102, as a rotational pressure applying member (nip forming member), which is kept pressed upon the fixation roller 101 to form the fixation nip N between the peripheral surface of the fixation roller 101 and the peripheral surface of the pressure roller 102; and fixation roller heating external unit 34 (belt unit). The external heating unit holding frame 48, as an external heating unit holding mechanism, is provided with a heating belt supporting rollers 103 and 104, and a fixation roller heating external belt 105 (which hereafter may be referred to simply as external heating belt 105). The external heating belt 105 is suspended by the rollers 103 and 104, which are held together by the fixation roller heating external unit holding frame 48 so that the rotational axes of the rollers 103 and 104 remain parallel to each other.

The fixing device 9 is structured so that the fixation roller 101 is rotationally driven in the direction indicated by an arrow mark A at a preset peripheral velocity, by a fixation roller driving mechanism M (FIG. 3) made up of a motor and a gear train. The fixation roller 101 has: a cylindrical metallic core (which in this embodiment is made of aluminum); a heat resistant elastic layer which is formed of silicone rubber, on the outward surface of the metallic core; and a heat resistant parting layer form of fluorinated resin (which in this embodiment is tube made of PFA (polytetrafluoroethylene) which covers the elastic layer to make it easier for toner to separate from the peripheral surface of the fixation roller 101.

The fixing device 9 is provided with a halogen heater 111, as a heating means, which is in the hollow of the metallic core of the fixation roller 101. The halogen heater 111 heats the fixation roller 101 from within the fixation roller 101 so that the surface temperature of the fixation roller 101 remains at a preset level. More specifically, the surface temperature of the fixation roller 101 is detected by a thermistor 121, as a temperature detecting means, which is in contact with the peripheral surface of the fixation roller 101. Based on this temperature detected by the thermistor 121, the control section 40 (FIG. 11) issues a command to a heater controlling section 140, which is a fixation roller temperature controlling (adjusting) means, to turn on or off the halogen heater 111 through a heater controller 43 and heater driver 44 (FIG. 11) so that the surface temperature of the fixation roller 101 remains at a preset target level.

The pressure roller 102 forms the fixation nip N between itself and the fixation roller 101 by being pressured upon the fixation roller 101 by a preset amount of pressure applied to the pressure roller 102 by an unshown pressure applying means. It is rotated in the direction indicated by an arrow mark B at a preset peripheral velocity, by the rotation of the fixation roller 101 which is rotationally driven by the unshown driving section.

The pressure roller 102 has: a cylindrical metallic core (which in this embodiment is made of aluminum); a heat resistant elastic layer which is formed of silicone rubber, on the outward surface of the metallic core; and a heat resistant parting layer formed of fluorinated resin (which in this embodiment is tube made of PFA) which covers the elastic layer to make it easier for toner to separate from the peripheral surface of the pressure roller 102.

The fixing device 9 is provided with a halogen heater 112, as a heating means, which is in the hollow of the metallic core of the pressure roller 102. The halogen heater 112 heats the pressure roller 102 from within the pressure roller 102 so that the surface temperature of the pressure roller 102 remains at a preset level. More specifically, the surface temperature of the pressure roller 102 is detected by a thermistor 122, as a temperature detecting means, which is in contact with the peripheral surface of the pressure roller 102. Based on this temperature detected by the thermistor 122, the control section 40 issues a command to a heater controlling section 140 to turn on or off the halogen heater 112 through a heater controller 43 and heater driver 44 (FIG. 11) so that the surface temperature of the pressure roller 102 remains at a preset target level.

[Fixation Roller Heating External Unit]

Next, referring to FIG. 1, the fixation roller heating external unit 34 (belt unit) with which the fixing device 9 is provided is described in detail.

Referring to 1, the fixing device 9 is provided with the fixation roller heating external belt 105, which is an endless belt for heating the fixation roller 101 by being placed in contact with the peripheral surface of the fixation roller 101. The belt 105 is suspended and kept stretched by the belt supporting upstream and downstream rollers 103 and 104, respectively, in terms of the rotational direction of the fixation roller 101, which function together as a belt supporting mechanism. The rollers 103 and 104 are positioned upstream and downstream, respectively, in terms of the moving direction of the belt 105, and suspend and keep stretched the belt 105. The fixing device 9 is structured so that the belt supporting rollers 103 and 104 circularly move the belt 105 while keeping the belt 105 pressed upon the peripheral surface of the fixation roller 101. Further, the fixing device 9 is structured so that the belt 105 is circularly moved by the rotational movement of the fixation roller 101, and the belt suspending rollers 103 and 104 are rotated by the circular movement of the belt 105.

The belt suspending rollers 103 and 104 are positioned in such a manner that their rotational axes are parallel to each other. They are kept pressed against the peripheral surface of the fixation roller 101 by a preset amount of pressure generated by a pressure applying section 204 (FIG. 3) such as a pair of compression springs, with the presence of the fixation roller heating external belt 105 between the two rollers 103 and 104, and the fixation roller 101. Thus, the outward surface of the belt 105 is kept pressed upon the peripheral surface of the fixation roller 101. Further, the fixing device 9 is structured so that the external heating belt 105 can be placed in contact with, or separated (retracted) from, the fixation roller 101, and also, so that as the external heating belt 105 is placed in contact with the fixation roller 101, it forms a heating nip Ne, between itself and fixation roller 101. Further, the fixing device 9 is structured to suspend the belt suspending rollers 104 and 105 in such a manner that as the external heating belt 105 is pressed upon the peripheral surface of the fixation roller 101, it is circularly movable by the rotation of the fixation roller 101.

The external heating belt 105 is made up of a substrate layer and a surface layer. The substrate layer is made of a metallic substance (stainless steel, nickel, or the like) or a resinous substance (PI or the like). The surface layer is for preventing toner from adhering to the external heating belt 105. It is formed of fluorinated resin (in this embodiment, substrate layer is covered with pieces of PFA tube). The external heating belt 105 heats the fixation roller 101 while remaining in contact with the peripheral surface of the fixation roller 101, being thereby circularly moved in the direction indicated by an arrow mark C in FIG. 1, at a preset peripheral velocity, by the rotation of the fixation roller 101.

The fixing device 9 is also provided with a cleaning roller 108, which is positioned in contact with the outward surface of the external heating belt 105. In terms of the rotational direction of the fixation roller 101, the cleaning roller 108 is between the fixation roller 101 and thermistor 121. More specifically, the cleaning roller 108 is on the upstream side of the thermistors 123 and 124 in terms of the moving direction of the external heating belt 105, and is kept pressed upon the external heating belt 105 by a preset amount of pressure. It is made up of a metallic core, and a porous surface layer formed of sponge or the like. It cleans the outward surface of the external heating belt 105 while remaining pressed upon the external heating belt 105 by a preset amount of pressure generated by an unshown pressure applying means.

In terms of the rotational direction of the fixation roller 101, the heating belt supporting roller 104, which is one of the rollers by which the external heating belt 105 is suspended, is on the downstream side, relative to the other heating belt supporting roller. The heating belt supporting roller 104 is made up of a metallic core, and a surface layer for minimizing the friction between the roller 104 and inward surface of the external heating belt 105. In this embodiment, the surface layer is a piece of tube made of PFA.

Further, the fixing device 9 is provided with a halogen heater 114, as a heating means, which is positioned in the hollow of the metallic core of the belt supporting roller 104 to internally heat the supporting roller 104 so that the surface temperature of the external heating belt 105 remains at a preset level.

Similarly, the heating belt supporting roller 103, which is one of the rollers by which the external heating belt 105 is suspended, internally heats the external heating belt 105 by being kept in contact with the inward surface of the external heating belt 105. The supporting roller 103 is made up of a metallic core, and a surface layer for minimizing the friction between the roller 103 and inward surface of the external heating belt 105. In this embodiment, the surface layer is a piece of tube made of PFA.

Further, the fixing device 9 is provided with a halogen heater 113, as a heating means (heater), which is positioned in the hollow of the metallic core of the belt supporting roller 103 to internally heat the supporting roller 103 so that the surface temperature of the external heating belt 105 remains at a preset level.

The surface temperature of the external heating belt 105 is detected by the thermistors 123 and 124. The thermistor 123, which is a temperature detecting means, is kept in contact with the external heating belt 105, in a range D1 of the area of contact between the belt supporting roller 103 and external heating belt 105. The thermistor 124, which also is a temperature detecting means, is kept in contact with the external heating belt 105, in a range D2 of the area of contact between the belt supporting roller 104 and external heating belt 105. It is based on the temperature levels detected by the thermistors 123 and 124 that the control section 140 (FIG. 11) issues a command to the heater control section 140 to make the control section 140 to turn on or off the halogen heaters 113 and 114 through the heater controller 34 and heater driver 44 so that the surface temperature of the external heating belt 105 reaches and remains at a preset level.

The target level for the temperature of the fixation roller heating external belt 105 is set to be higher than that of the fixation roller 101 for the following reason. That is, keeping the heating belt 105 higher in temperature than the fixation roller 101 makes the heating belt 105 quicker in its response (accuracy in thermal response) to the drop in the surface temperature of the fixation roller 101 attributable to a sheet of recording medium which is being conveyed through the fixing device 9; heat is quickly (efficiently) transferred from the heating belt 105 to the fixation roller 101.

Figure 3:
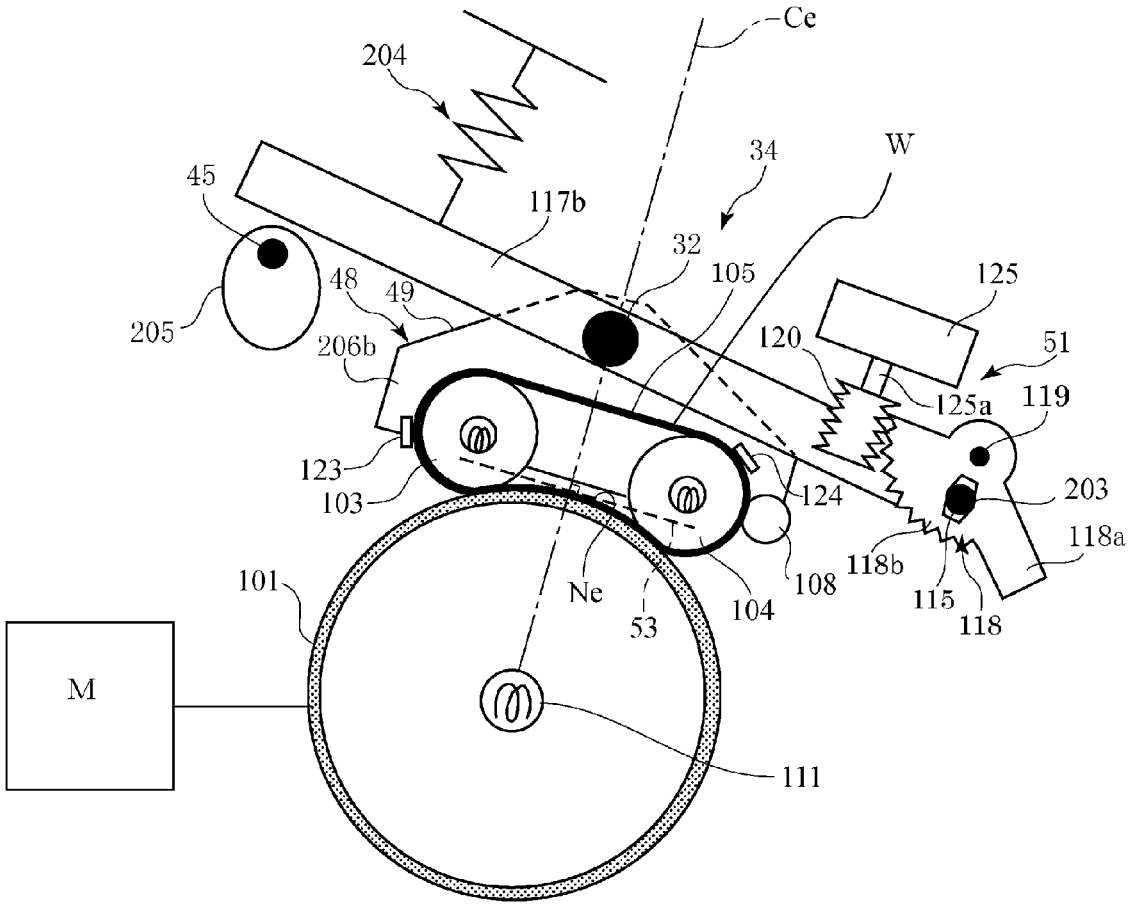
FIG. 3 is a front view of the fixation roller heating external unit of the fixing device in the first embodiment of the present invention. It shows the general structure of the unit.
Figure 4:
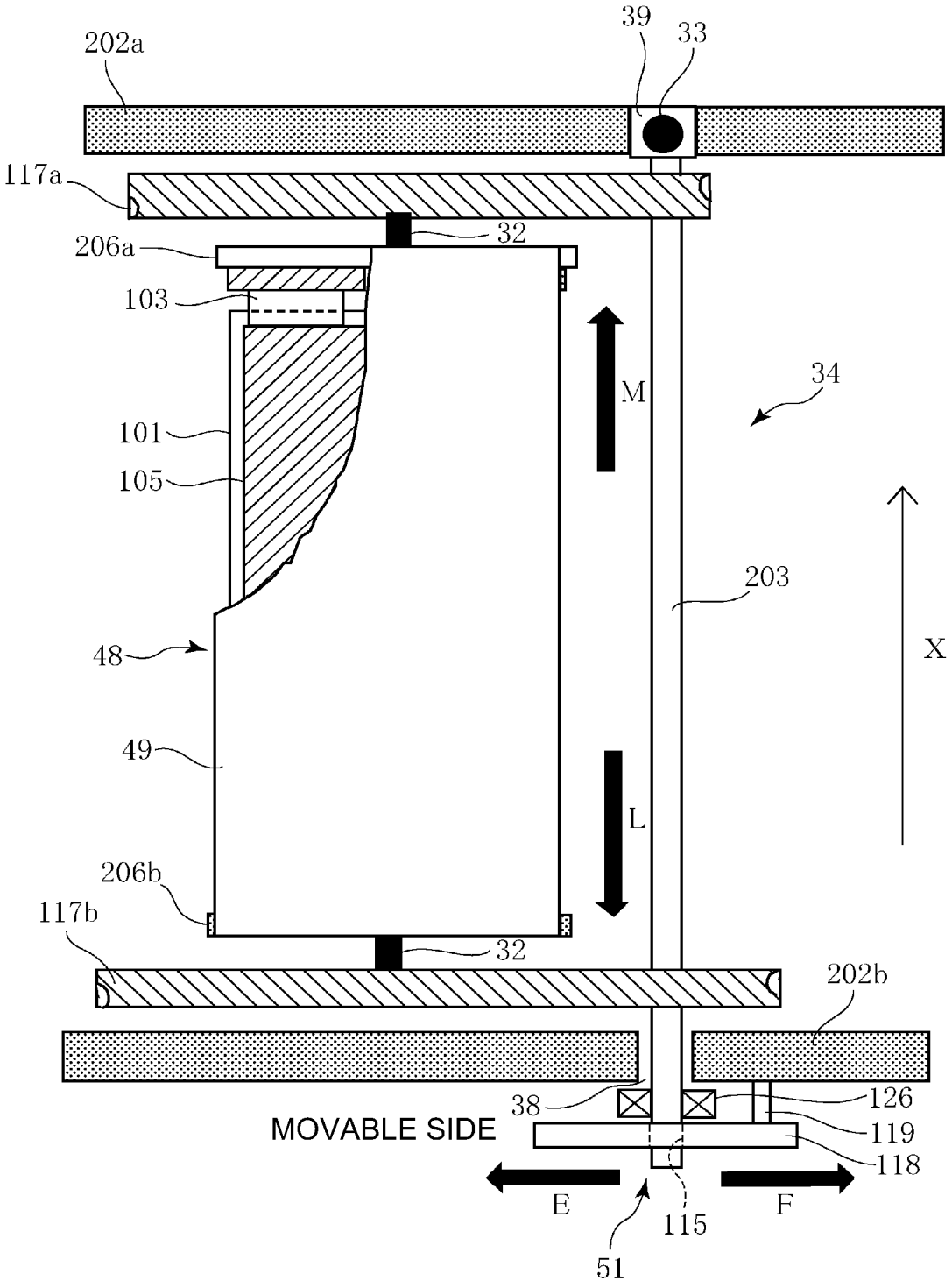
FIG. 4 is a partially broken plan view of the fixation roller heating unit of the fixing device in the first embodiment, as seen from the direction perpendicular to the recording medium conveyance direction. It shows the general structure of the unit.

FIG. 3 is a front view of the fixation roller heating external unit, in this embodiment, having the heating belt 105. It shows the structure of the unit. FIG. 4 is a plan view of the fixation roller heating external unit, in this embodiment, having the heating belt 105, as seen from the direction perpendicular to the lengthwise direction of the unit. It shows the structure of the unit.

Referring to FIGS. 3 and 4, the fixing device 9 is structured so that its fixation roller heating external unit 34 is rotationally (pivotally) movable by the mechanism (which will be described next), so that the axial lines of the heating belt supporting rollers 103 and 104 intersect with the direction of generatrix of the peripheral surface of the fixation roller 101 (direction indicated by arrow mark X in FIGS. 4 and 8), while making the rollers 103 and 104 keep the heating belt 105 pressed upon the fixation roller 101. That is, the fixation roller heating external unit 34 has an external heating unit supporting frame 48, and a shaft 203 positioned between the lateral plates 202*a* and 202*b* of the external frame (casing) of the fixing device 9. The shaft 203 is supported by a side plate 202*a*, that is, one of the lateral plates of the external frame of the fixing device 9, by one of its lengthwise ends, in such a manner that it can be pivotally moved in the left or right direction of FIG. 4, about a pivot 33 of a shaft supporting member 39 which is a device for holding the fixation roller heating external unit 34 in such a manner that the unit 34 can be rotationally (pivotally) moved. The other end of the shaft 203 is put through a through hole 38 with which the lateral plate 202*b* of the external frame of the fixing device 9. The diameter of the through hole 38 is greater than the external diameter of the shaft 203. The abovementioned lengthwise end of the shaft 203 is supported by the pivot 33. Therefore, the shaft 203 is pivotally movable in the direction indicated by an arrow mark E in FIG. 4, or the direction indicated by an arrow mark F in FIG. 4. As described above, the frame 48 for holding the fixation roller heating external unit 34 is supported by the end (top end in FIG. 4) in terms of the direction of the rotational axis of the fixation roller 101 (top-to-bottom direction in FIG. 4) so that it can be pivotally moved about the top end.

Further, the fixing device 9 is provided with a pair of pressure application arms 117*a* and 117*b* which are between the lateral plates 202*a* and 202*b* of the external frame of the fixing device 9. The pressure application arms 117*a* and 117*b* are rotationally (pivotally) supported by the shaft 203 which extends from one end of the fixing device 9 to the other. They are kept pressed toward the fixation roller 101 by the pressure from aforementioned pressure applying section 204. The pressure application arm 117*a* is positioned next to the lateral plate 202*a* of the external frame of the fixing device 9, in such manner that it extends in the lengthwise direction of the lateral plate 202*b*.

That is, the holding unit 48 is supported by a pair of shafts 32, by its supporting members 206*a* and 206*b* (lateral plates), in such a manner that it is rotationally (pivotally) movable about the shafts 32. Further, the shafts 32 are attached to the roughly center portions of the pressure application arms 117*a* and 117*b*, respectively, in terms of the lengthwise direction of the arms 117*a* and 117*b*. Further, the aforementioned heating belt supporting rollers 103 and 104, by which the fixation roller heating external belt 105 is suspended, are rotatably supported by the lateral plates 206*a* and 206*b* of the supporting unit 48. The lateral plates 206*a* and 206*b* are connected to each other by their top portions, by a plate 49 which bridges between the two lateral plates 206*a* and 206*b*.

Further, the fixation roller heating external unit supporting unit 34 is provided with a roughly elliptic cam 205, which is rotatably supported by a shaft 45. The cam 205 is below the front end portion (left end portion in FIG. 3) of the pressure application arm 117*b*, or the front arm, in FIG. 3. The cam 205 functions as a part of the mechanism which moves the pressure application arms 117*a* and 117*b* to place the heating belt 105 in contact with, or separated from, the fixation roller 101. That is, the cam 205 moves the pressure application arms 117 by pressing the pressure application arm 117*b* upward against the resiliency of the pressure applying section 204, or allowing the pressure application arm 117*b* to be moved downward by the pressure generated by the resiliency of the pressure application section 204. Thus, the fixation roller heating external belt 105 indirectly held by the lateral plates 202*a* and 202*b*, through the shafts 32 and 32, lateral plates 206*a* and 206*b*, and belt supporting rollers 103 and 104, can be placed in contact with, or separated from, the fixation roller 101.

The lengthwise end portion of the shaft 203, which protrudes outward of the lateral plate 202*b* through the through hole 38 of the lateral plate 202*b*, is rotatably supported by a bearing 126, which is on the outward side of the lateral plate 202*b*. It is also put through the elongated hole 115 with which a sector gear 118 (fan-shaped gear) is provided, in such a manner that the lengthwise end portion of the shaft 203 is allowed to slide along the edge of the elongated hole 115. That is, the lengthwise end portion of the shaft 203 is put through the bearing 126, which is positioned between the lateral plate 202*b* of the external frame of the fixing device 9, and the sector gear 118.

Figure 5:
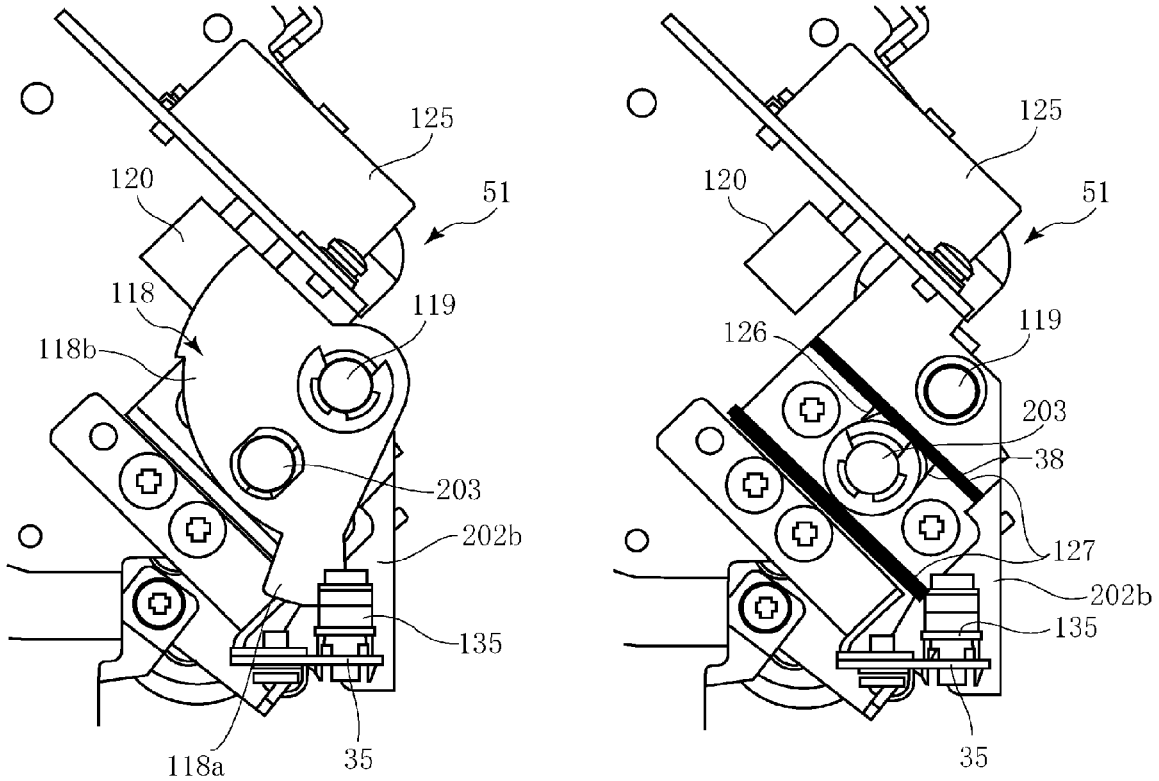
FIG. 5(*a*) is a front view of the driving section of the fixation roller heating external unit in the first embodiment, and FIG. 5(*b*) is a front view of the driving section of the fixation roller heating external unit, minus its sector gear, in the first embodiment. They show the general structure of the driving section.

The sector gear 118 is on the outward side of the lateral plate 202*b* of the external frame of the fixing device 9, and is rotatably supported by a shaft 119 attached to the lateral plate 202*b*. It has: a downwardly facing toothed section 118*b*; the aforementioned elongated hole 115, the lengthwise direction (long axis) of which coincides with the axial line of the shaft 119; and a light blocking section 118*a* which is next to the toothed section 118*b* and extends roughly downward. Thus, as the sector gear 118 is pivotally moved about the shaft 119, its light blocking section 118*a* moved into, or out of, the slit between the light emitting portion and light sensing portion of a photo-interrupter 135 (FIG. 5). Next, referring to FIGS. 5(*a*) and 5(*b*), the photo-interrupter 135 is attached to the lateral plate 202*b* of the external frame of the fixing device 9, with the use of a bracket 35, so that it coincides in position to the light blocking portion 118*a*.

The fixation roller heating external unit supporting unit 34 is provided with a motor 125 which is supported by the lateral plate 202*b* of the external frame of the fixing device 9, being positioned adjacent to the sector gear 118. To the axle 125*a* of the motor 125, a worm gear 120 is solidly attached. The motor 125, worm gear 118, shaft 203, etc., make up the mechanism 51 for pivotally moving the external heating unit holding frame 48. This mechanism 51 is enabled to pivotally move the fixation roller heating external unit 34 (external heating unit holding frame 48) so that the axial lines of the belt supporting rollers 103 and 104 intersect with the axial line of the fixation roller 101 (generatrix direction), while keeping the external heating belt 105 pressed upon the peripheral surface of the fixation roller 101.

Next, referring to FIG. 3, the rotational axis Ce of the external heating unit holding frame 48 is perpendicular to the area of contact (nip Ne) between the external heating belt 105 and fixation roller 101. That is, the fixing device 9 is structured so that the rotational axis Ce coincides with the center of the area of contact between the external heating belt 105 and fixation roller 101, in terms of the rotation direction of the fixation roller 101, and is parallel to the line normal to a line 53 which is tangent to the peripheral surface of the fixation roller 101 at the center of the area of contact between the external heating belt 105 and fixation roller 101. In other words, the rotational axis Ce is virtually parallel to the normal line to the portion (portion W in FIG. 3) of the external heating belt 105, which is the flat portion of the belt 105 between the heat belt supporting rollers 103 and 104, that is, the portion which is not in contact with the fixation roller 101.

In this embodiment, the axial line Ce is realized by the pressure application arms 117*a* and 117*b* which support the external heating unit holding frame 48, and the pivot 33 around which the shaft 203 by which the pressure application arms 117*a* and 117*b* are supported by one of their lengthwise ends. The axial line Ce is at one of the lengthwise ends of the fixation roller 101, in terms of the direction of its axial line (top-to-bottom direction in FIG. 4). Further, the axial line Ce is perpendicular to the axial line (which extends in front-to-rear direction) of the fixation roller 101 (image heating member).

Figure 6:
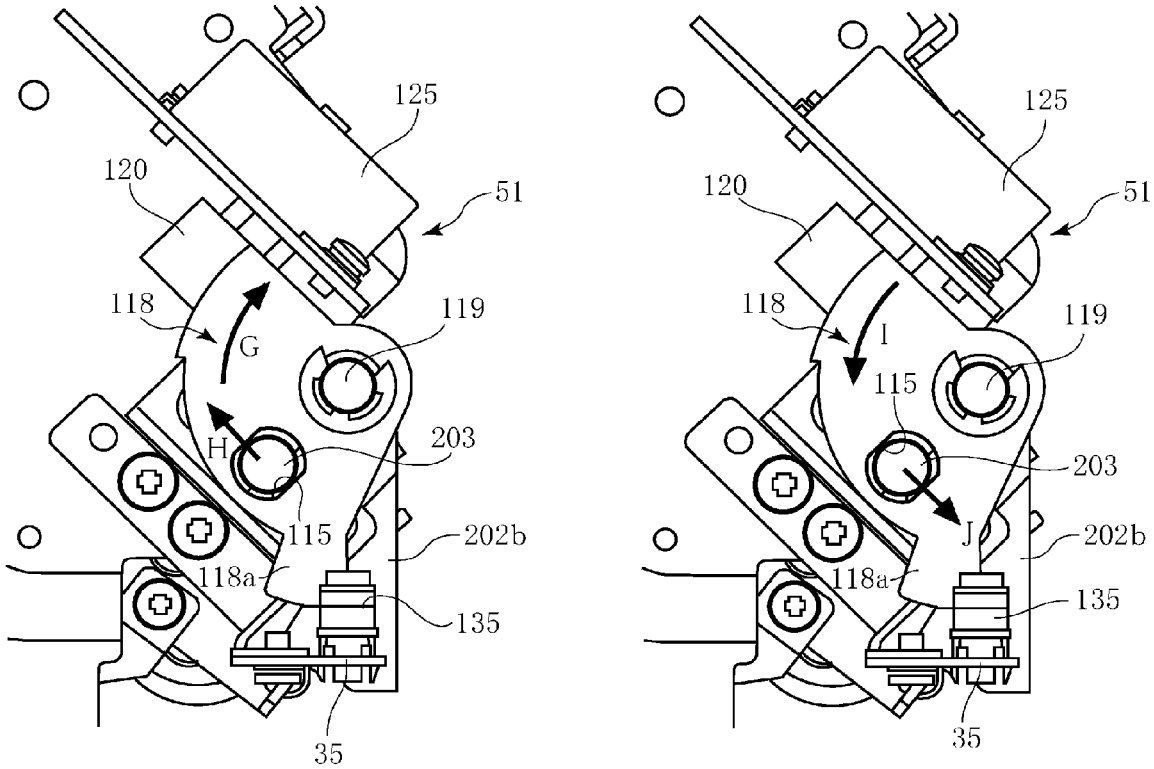
FIGS. 6(*a*) and 6(*b*) are front views of the driving section of the fixation roller heating external unit in the first embodiment, as seen when the unit is being driven.

FIG. 5(*a*) is a front view of the portion (mechanism 51) of the fixing device 9, which is for driving the fixation roller heating external unit 34 in this embodiment, and FIG. 5(*b*) is a front view of the same portion of the fixing device 9 as FIG. 5(*a*), minus the sector gear 118. FIG. 6(*a*) is a front view of the portion (mechanism 51) of the fixing device 9, which is for driving the fixation roller heating external unit 34 in this embodiment, as seen while the portion (mechanism 51) is pivotally moving the external heating unit 34 (external heating unit holding frame 48). First, the case in which the fixation roller heating external unit 34 (external heating unit holding frame 48) is pivotally moved in such a direction that the front end of the unit 34 moves upstream (direction indicated by arrow mark E in FIG. 4), is described.

First, the motor 125 is driven to rotate the worm gear 120, whereby the sector gear 118 is rotated in the direction indicated by an arrow mark G in FIG. 6(*a*). The elongated hole 115 of the sector gear 118 extends in the direction parallel to the line which connects the center of the shaft 203 and pivot 119 of the sector gear 118.

Next, referring to FIG. 5(*b*), the mechanism 51 for moving the fixation roller heating external unit 34 is provided with a pair of straight guides 127 and 127 which are parallel to each other. The two guides 127 and 127 are on the outward side of the lateral plate 202*b* of the external frame of the fixing device 9, and are angled so that their left ends are positioned higher than their right ends. One of the guides 127 is on the top side of the bearing 126, and the other is on the bottom side of the bearing 126. Thus, the bearing 126 is allowed to move not only in the direction parallel to the two guides 127 and 127, and also, in the direction which is intersectional to the guides 127 and 127, by a distance equal to the clearance between the shafts 203 and the wall of through hole 38. Thus, the bearing 126, through which the shaft 203 is put, is allowed to move in the direction parallel to the lengthwise direction of the guides 127 and 127 while being regulated in its vertical movement by the guides 127 and 127.

Therefore, as the motor 125 is rotated forward, the sector gear 118 is rotated, through the worm gear 120, in the direction indicated by the arrow mark G in FIG. 6(*a*), causing thereby the shaft 203 to linearly move in the preset direction (indicated by arrow mark H in FIG. 6(*a*)). This linear movement of the shaft 203 is realized by the coordination among the guides 127 and 127, the bearing 126, and the shaft 203 pivotally attached to the pivot 33 by one end and put through the elongated hole 115 of the lateral plate 202*b* of the external frame of the fixing device 9 by the other end.

That is, as the worm gear 120 is rotated by the forward rotation of the motor 125, the sector gear 118 is pivoted in the direction indicated by the arrow mark G in FIG. 6(*a*), causing thereby the bearing 126 to move along the guides 127 and 127. Thus, the shaft 203 is moved in the direction indicated by the arrow mark H by the bearing 126 which moves along the guides 127 and 127, while being guided by the elongated hole 115 which extends in the direction parallel to the line which connects the center of the shaft 203 and center of the pivot 119. Consequently, the shaft 203 is pivoted in such a manner that the opposite end the shaft 203 from the pivot 119 linearly moves leftward in FIG. 6(*a*). This linear movement of the opposite end of the shaft 203 causes the external heating unit holding frame 48 to pivot in such a manner that its front end moves upstream (direction indicated by arrow mark E in FIG. 4), along with the shaft 203.

On the other hand, if it is necessary for the external heating unit holding frame 48 to be pivoted in such a manner that its front end moves downstream (direction indicated by arrow mark F in FIG. 4), all that is necessary is to rotate the motor 125 in reverse, that is, the direction opposite to the above described direction. As the worm gear 120 is made to pivot by the reverse rotation of the motor 125, the sector gear 118 is made to pivotally move in the direction indicated by an arrow mark I in FIG. 6(*b*), whereby the bearing 126 is made to linearly moved in the direction indicated by an arrow mark J, that is, the opposite direction from the above described direction, along the guides 127 and 127. Thus, the opposite end of the shaft 203 from the pivot 119 linearly move rightward in FIG. 6(*b*). This linear movement of the opposite end of the shaft 203 causes the external heating unit holding frame 48 to pivotally move in such a manner that its front end moves downstream (direction indicated by arrow mark F in FIG. 4) along with the shaft 203.

As described above, as the shaft 203 is made to pivot in such a manner that its front end portion, to which the external heating unit holding frame 48 is attached, moves upstream or downstream, the frame 48, which is supported by the shaft 203, rotationally moves about the rotational axis Ce (about pivot 33, in reality). Consequently, the angle of intersection between the heating belt supporting rollers 103 and 104, and the fixation roller 101 changes.

It has been known that in the case of the fixing device 9 equipped with the fixation roller heating external device which uses an endless heating belt, there is a correlation between the angle of the fixation roller 101 with which the external heating belt 105 is placed in contact, and the external heating belt 105 (belt supporting rollers 103 and 104), and the amount by which the external heating belt 105 laterally shifts (deviates in position) as it is circularly moved. Thus, the fixing device 9 can be controlled in the unwanted lateral shift of the external heating unit 105, by pivotally moving the shaft 203 in such a manner that the portion of the shaft 203, to which the external heating unit holding frame 48 is attached, moves upstream or downstream in terms of the direction in which recording medium is conveyed, because moving the portion of the shaft 203, to which the front end of the external heating unit holding frame 48 is attached, upstream or downstream changes the angle of intersection between the external heating belt 105 suspended by the belt supporting rollers 103 and 104, and the fixation roller 101, which in turn controls the lateral shifting of the external heating belt 105.

Figure 7:
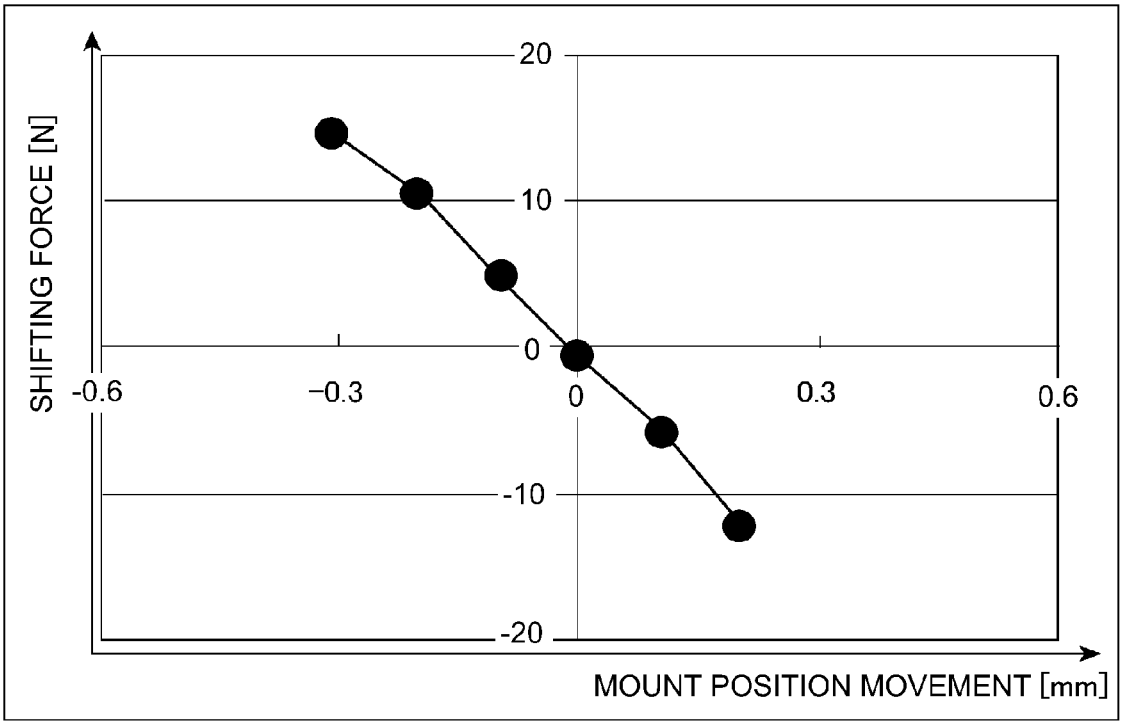
FIG. 7 is a graph which shows the relationship between the distance by which the point of contact between the shaft 203 and sector gear 118, and the amount of load to which the external heating belt is subjected in a manner to be laterally shifted.

Here, referring to FIG. 7, the relationship between the amount by which the front end of the external heating unit holding frame 48 is moved, and the amount of force generated in the direction to laterally shift the external heating belt 105 is described. FIG. 7 shows the relationship between the amount of force generated in the direction to laterally shift the external heating belt 105, and the amount by which the portion of the shaft 203, to which the front end of the external heating unit holding frame 48 is attached, is moved.

The amount of force by which the external heating belt 105 was made to laterally shift (deviate) was measured by placing a pair of rollers in contact with the lateral edges of the external heating belt 105 one for one. That is, as the external heating belt 105 was circularly moved by the rotation of the fixation roller 101, the amount of load to which one of the rollers was subjected by the lateral shift (deviation) of the heating belt 105 in the direction parallel to the rotational axis of the belt supporting rollers 103 and 104, was measured with a load cell (unshown).

The horizontal axis of the graph in FIG. 7 stands for the amount [mm] by which the front end of the external heating unit holding frame 48 (shaft 203) moved, and the vertical axis stands for the amount [N] of force by which the external heating belt 105 is made to laterally shift. In FIG. 7, a point (0, 0) is the idealistic point, that is, a point at which the circular movement of the external heating belt 105 does not cause the belt 105 to laterally shift.

Also in the graph, the plus and minus directions correspond to the upstream and downstream directions (indicated by arrow marks E and F, respectively, in FIG. 4) in which the free end (front end) of the shaft 203 moves, respectively. Regarding the amount [N] of force by which the external heating belt 105 is moved, and which is represented by the vertical axis of the graph, the positive side corresponds to the force which works in the direction to move the external heating belt 105 frontward of the fixing device 9 (direction indicated by arrow mark L in FIG. 4), and the negative side corresponds to the force which works in the direction to move the external heating belt 105 rearward of the fixing device 9 (direction indicated by arrow mark M in FIG. 4).

It has been confirmed that as the point of attachment of the front end of the external heating unit holding frame 48 to the shaft 203 shifts upstream from the ideal point, the amount of force which works in the direction to shift the external heating belt 105 rearward in terms of the lengthwise direction of the fixation roller 101 (direction indicated by arrow mark M in FIG. 4) increases, whereas as the point of attachment of the front end of the external heating unit holding frame 48 to the shaft 203 shifts downstream from the ideal point, the amount of force which works in the direction to shift the external heating belt 105 frontward in terms of the lengthwise direction of the fixation roller 101 (direction indicated by arrow mark L in FIG. 4) increases, as is evident from the graph in FIG. 7. Thus, the direction in which the external heating belt 105 shifts can be reliably controlled by pivotally moving the shaft 203, with the use of the mechanism 51 for pivotally moving the shaft 203, which is structured as in this embodiment.

[System for Detecting Shifting of External Heating Belt]

Figure 8:
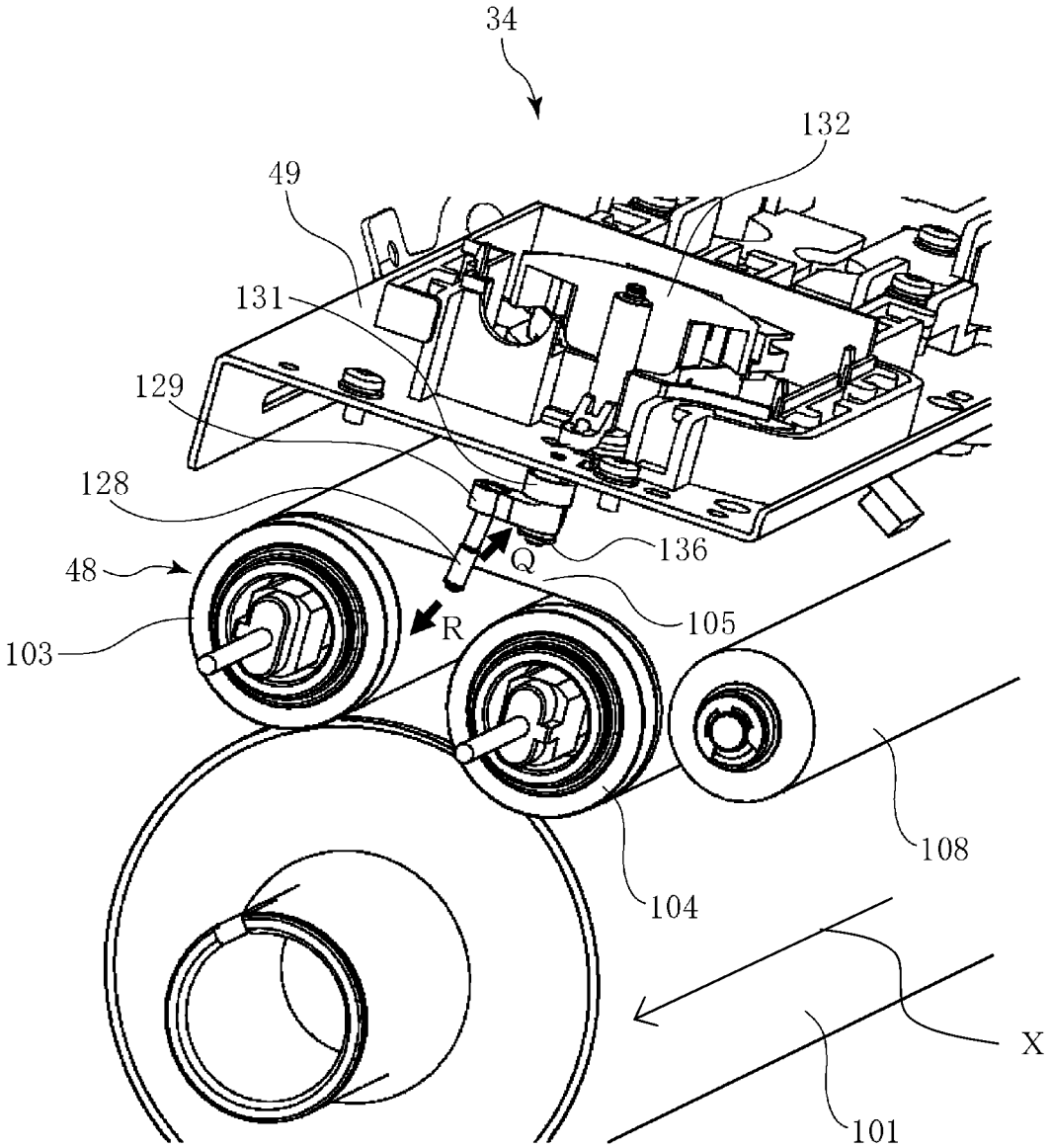
FIG. 8 is an external perspective view of the mechanism of the fixing device in the first embodiment, which is for detecting the amount of positional deviation (lateral shift) of the fixation roller heating external belt.
Figure 9:
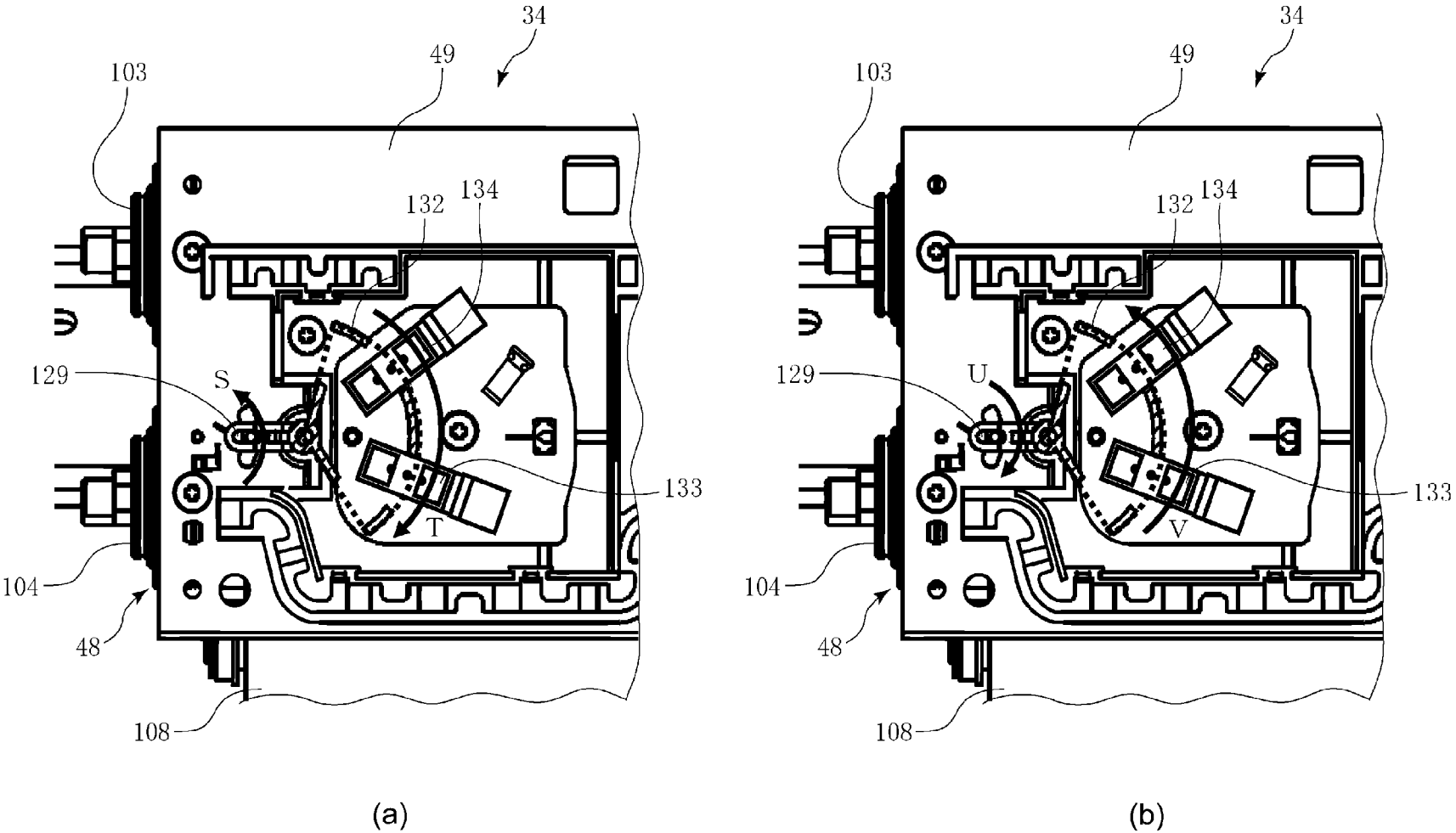
FIGS. 9(*a*) and 9(*b*) are plan views of the mechanism of the fixing device in the first embodiment, which is for detecting the lateral shift of the external heating belt of the fixing device, as seen when the mechanism is in action.

Next, referring to FIGS. 8, 9(*a*) and 9(*b*), the system, in this embodiment, for detecting the position of the external heating belt 105 in terms of its widthwise direction is described. FIG. 8 is an external perspective view of the system, in this embodiment, for detecting the position of the external heating belt 105. FIGS. 9(*a*) and 9(*b*) are plan views of the system, shown in FIG. 8, while the system is in action.

In this embodiment, the external heating belt 105 is controlled so that while it is circularly moved by the rotation of the fixation roller 101, it remains within a preset range (normal range) in terms of the widthwise direction of the external heating belt 105 (lengthwise direction of fixation roller 101). Thus, the fixing device 9 is provided with a system (detector) for detecting whether or not the external heating belt 105 is within the preset range. The system for detecting the position of the external heating belt 105 is structured so that it can detect that the external heating belt 105 is outside the preset range. If it detects that the external heating belt 105 is out of the preset range, it makes the shaft 203 (fixation roller heating external unit 34) pivot in the direction for shifting the external heating belt 105 back into the preset range. More concretely, it pivotally moves the shaft 203 (fixation roller heating external unit 34) in such a direction that the axial lines of the heating belt supporting rollers 103 and 104, by which the external heating belt 105 is kept pressed upon the peripheral surface of the fixation roller 101, intersect with the generatrix of the peripheral surface of the fixation roller 101. In this embodiment, the range in which the angle θ, at which the axial lines of the external belt supporting rollers 103 and 104 intersect with the direction of the generatrix of the peripheral surface of the fixation roller 101, is kept within 1.25° (±1.25° (+corresponds to clockwise direction)).

More concretely, the system for detecting the heating belt shift, which is a detector, has a roller 128 and an arm 129, which are positioned at one of the lateral edges of the external heating belt 105 (in terms of direction intersectional (perpendicular) to circular movement of external heating belt 105). The roller 128 is rotatably attached to the arm 129 so that it remains in contact with the lateral edge of the external heating belt 105. The arm 129 is positioned at one of the lateral edges of the connective plate 49 of the external heating unit holding frame 48 of the external heating unit 34. The arm 129 is enabled to pivotally move about the shaft 136, and is kept pressed in the direction indicated by an arrow mark Q in FIG. 8 by a pressure applying member 131, such as a spring, which generates roughly 200 gf of force.

The arm 129 is in connection to a sensor flag 132, which has two slits. This sensor flag 132 is supported so that it is movable by the pivotal movement of the arm 129. It is provided with photo-interrupters 133 and 134 (FIGS. 9(*a*) and 9(*b*)).

As the external heating belt 105 shifts frontward in terms of the axial line (lengthwise direction) of the fixation roller 101 (direction indicated by arrow mark L in FIG. 4), the external heating belt 105 pushes the roller 128 in the direction indicated by an arrow mark R in FIG. 8. Consequently, the arm 129 is subjected to a force which is greater than the force generated by the resiliency of the pressure applying member 131, being thereby pivotally moved about the shaft 136 (pivot) in the direction indicated by an arrow mark S in FIG. 9(*a*).

Figure 11:
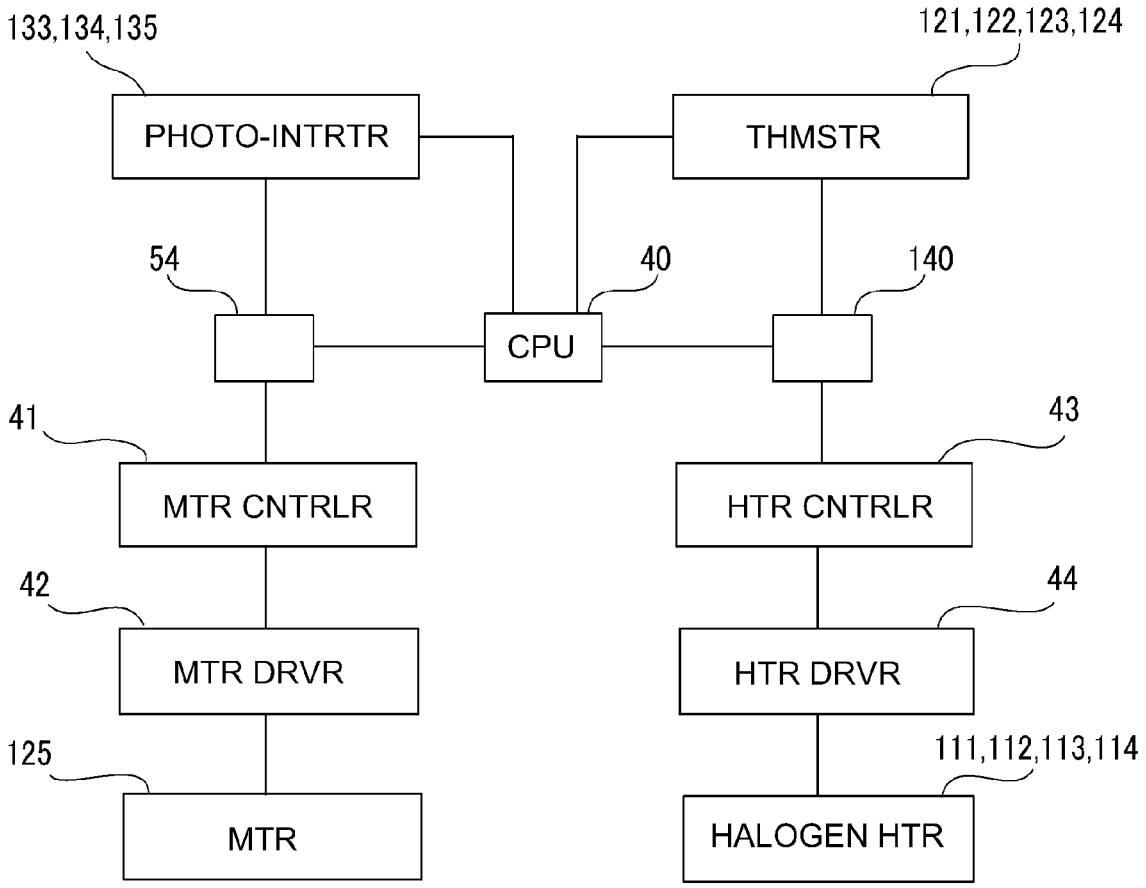
FIG. 11 is a block diagram of the system for controlling the fixation roller heating external belt unit, in the first embodiment.

Thus, the sensor flag 132 is rotationally moved by the pivotal movement of the arm 129 in the direction indicated by an arrow mark G in FIG. 9(*a*), being thereby made to enter into the slit (unshown) between the light emitting and light sensing portions of the photo-interrupter 133, that is, one of the pair of photo-interrupters positioned at the two sides of the shaft 136 (pivot), and therefore, blocking the light emitted by the light emitting portion. The signal outputted by the photo-interrupter 133 as the light emitted by the light emitting portion is interrupted by the flag 132 is received by the control section 40 (FIG. 11). Thus, the control section 40 determines that the external heating belt 105 has shifted frontward (direction indicated by arrow mark L in FIG. 4), and issues a command for making the belt shift control portion 54 of the fixing device 9 begin controlling the external heating belt 105 in lateral shift. Thus, the belt shift control portion 54 drives the motor 125, through the motor controller 41 and motor driver 42, in the direction to shift the external heating belt 105 in the direction opposite to the direction in which it has been shifting.

In this embodiment, the combination of the mechanism 51 for pivotally moving the shaft 203, and shift control portion 54, functions as the means for adjusting the external heating belt 105 in the position in terms of the widthwise direction of the external heating belt 105. This heating belt position adjusting means adjusts the external heating belt 105 in position in terms of the widthwise direction of the belt 105, which is intersectional (perpendicular) to the moving direction of the external heating belt 105, by pivotally moving the shaft 203, rotationally moving thereby the external heating unit holding frame 48 about the rotational axis Ce, which is perpendicular to the area of contact (Ne) between the fixation roller 101 and external heating belt 105. Further, the mechanism 51 for pivotally moving the shaft 203 functions as a means for rotationally moving the external heating unit holding frame 48, whereas the belt shift control portion 54 functions as a means for controlling the amount (angle) by which the external heating unit holding frame 48 is to be rotationally moved by the mechanism 51.

On the other hand, if the external heating belt 105 shifts rearward in terms of the axial line (lengthwise direction) of the fixation roller 101 (direction indicated by arrow mark M in FIG. 4), the external heating belt 105 moves in the direction to move away from the roller 128. Consequently, the arm 129, which is under the pressure generated by the pressure applying member 131 in the direction to pivotally move the arm 129 in the direction indicated by the arrow mark Q, pivots in the direction indicated by an arrow mark U in FIG. 9(*b*).

Thus, the sensor flag 132 is rotationally moved by the pivotal movement of the arm 129 in the direction indicated by an arrow mark V in FIG. 9(*b*), being thereby made to come out of the slit (unshown) between the light emitting and light sensing portions of the photo-interrupter 133. As soon as the flag 132 is made to come out of the slit, it is made to move into the slit (unshown) between the light emitting portion and light sensing portions of the photo-interrupter 134, blocking thereby the light emitted by the light emitting portion. The signal outputted by the photo-interrupter 134 as the light emitted by the light emitting portion is interrupted by the flag 132 is received by the control section 40. Thus, the control section 40 determines that the external heating belt 105 has shifted rearward (direction indicated by arrow mark M in FIG. 4), and issues to the belt shift control portion 54 of the fixing device 9, a command to make the belt shift control portion 54 begin controlling the external heating belt 105 in lateral shift. Thus, the belt shift control portion 54 drives the motor 125, through the motor controller 41 and motor driver 42, in the direction to shift the external heating belt 105 in the direction opposite to the direction in which it has been shifting.

[Shift Control System]

The shift control system is structured to support the shaft 203 by the sector gear 118 in such a manner that when the shaft 203 is in its home position, the fixation roller heating external heating unit 34 (external heating unit holding frame 48) is in its home position, and the rotational axis of the fixation roller 101 is parallel to the rotational axes of the heating belt supporting rollers 103 and 104. Whether the external heating unit holding frame 48 is in its home position or not is determined by the control section 40 (controller) based on the output of the photo-interrupter 135 (FIGS. 6 and 11) attached to the sector gear 118.

Next, referring to FIG. 4, the photo-interrupter 135 is positioned so that it can detect the movement of the pressure application arm 117*b* (shaft 203) relative to the lateral plate 202*b* of the external frame of the fixing device 9. That is, as described with reference to FIGS. 5(*a*) and 5(*b*), the shaft 203 (pressure application arm 117*b*) is put through the elongated hole 115 of the sector gear 118, and the position of the sector gear 118 in terms of the direction of its pivotal movement is detected as the light blocking portion 118*a* of the sector gear 118 is detected by the photo-interrupter 135. Therefore, the amount of the movement of the pressure application arm 117*b* relative to the lateral plate 202*b* of the external frame of the fixing device 9 can be detected by detecting the angular position of the sector gear 118.

Regarding the operation of the shift control system, the external heating belt 105 is rotated by the rotation of the fixation roller 101, possibly shifting frontward or rearward in terms of the widthwise direction of the belt 105 (lengthwise direction of fixation roller 101). If the belt 105 happens to shift frontward or rearward, the control section 40 moves the point of attachment of the external heating unit holding frame 48 to the shaft 203 in such a direction that a force which is opposite in direction to the force which has been working in the direction to laterally shift the belt 105 is generated. That is, in the case of this shift control system, the photo-interrupters 133 and 134 are positioned so that as the external heating belt 105 laterally shifts by a preset amount, for example, 5 mm, from the home position, the shifting of the belt 105 can be detected. Further, the amount by which the shaft 203 is allowed to pivotally move before the belt shift control system begins to respond is set to 2 mm from the abovementioned home position, either upstream or downstream.

As described above, in this embodiment, the belt shift control system and shift detection system are expertly combined as described above. Therefore, the fixing device 9 is smoothly and accurately controlled in terms of the lateral shifting of its fixation roller heating external belt 105.

[Control of Belt Shift Control System]

Next, referring to FIG. 11, the control of the belt shift control system (system for controlling lateral shift of external heating belt 105) in this embodiment is described. FIG. 11 is a block diagram of the control sequence of the belt shift control system.

The control section 40 made up of a CPU or the like for integrally controlling the operation of each of the components of the fixing device 9 (image forming apparatus 100) is within the main assembly of the image forming apparatus 100. The control section 40 is in connection to the belt shift control portion 54 of the fixing device 9, and also, to the heater control section 140 which controls the heating of the fixation roller 101, pressure roller 102, and external heating belt 105 of the fixing device 9. The belt shift control portion 54 controls the external heating belt 105 in lateral shift by controlling the external heating unit holding frame 48 of the fixation roller heating external unit 34 in its attitude relative to the fixation roller 101. Further, the control section 40 is in connection to the photo-interrupters 133, 134 and 135, and thermistors 121, 122, 123 and 124.

The belt shift control portion 54 is in connection to the motor controller 41. The aforementioned roller 128 for detecting the position of the external heating belt 105, and the photo-interrupters 133 and 134 make up the means for detecting the lateral shifting of the external heating belt 105. The belt shift control portion 54 (controlling means) controls the mechanism 51 for rotationally moving the fixation roller heating external unit 34, based on the amount of the lateral shift of the belt 105 detected by the belt deviation detecting means (128, 133 and 134). The motor controller 41, which also was mentioned previously, drives the motor 125, through the motor driver 42, in response to the signal outputted by the belt shift control portion 54 in response to the command issued by the control section 40.

The heater control portion 140 is in connection to the heater controller 43, which turns on or off the halogen heaters 111, 112, 113 and 114, through the heater driver 44, in response to the signals outputted by the heater control portion 140 in response to the command issued by the control section 40. This is how the temperatures of the fixation roller 101, pressure roller 102, and external heating belt 105 are increased to, and kept at, their target levels.

[Belt Shift Control Sequence]

Figure 10:
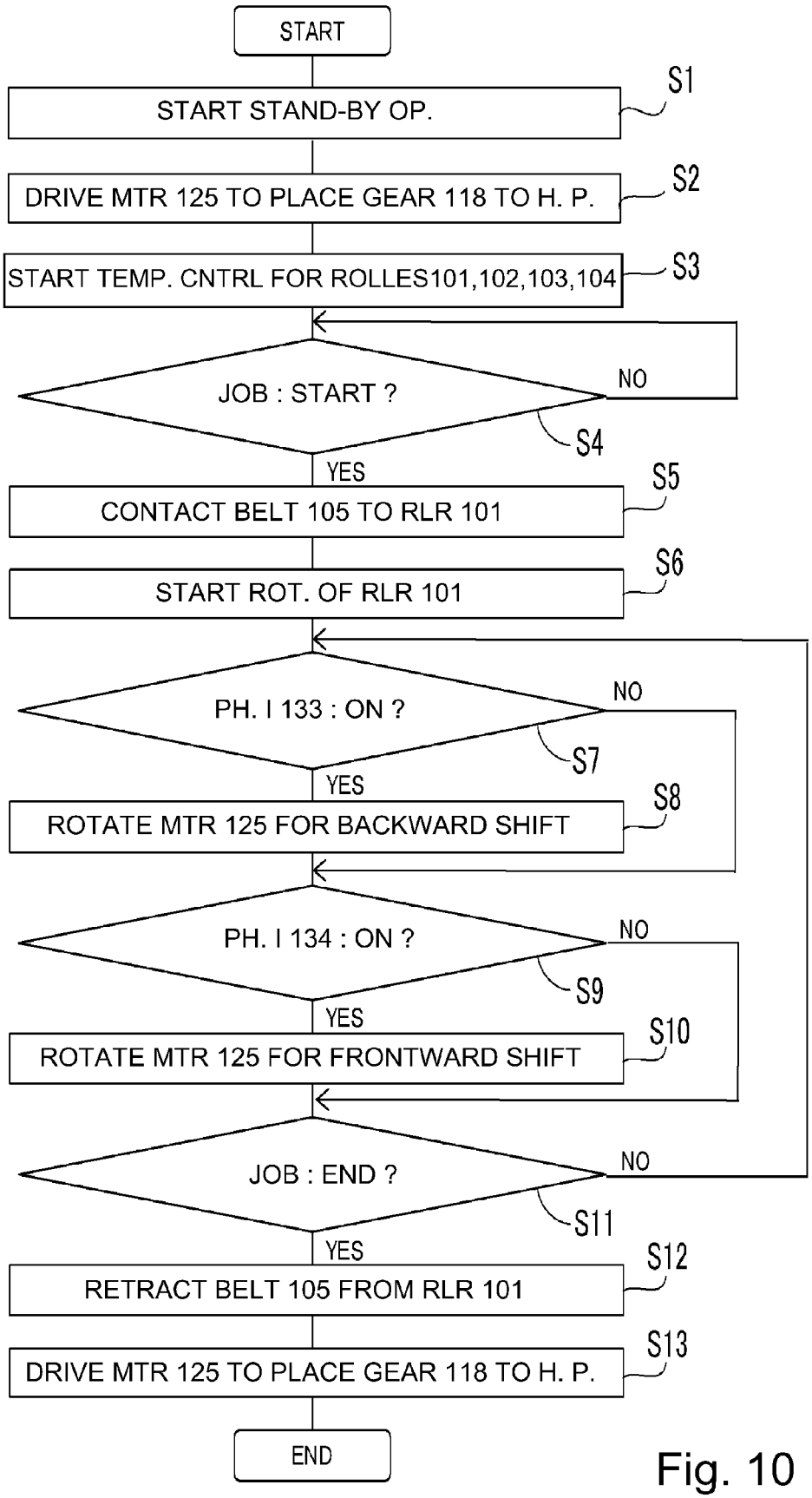
FIG. 10 is a flowchart of the control sequence of the operation for controlling the positional deviation (lateral shift) of the fixation roller heating external belt in the first embodiment.

Next, referring to FIGS. 10 and 11, the operation of the fixing device 9 in this embodiment is described. FIG. 10 is a flowchart of the control sequence for controlling the fixing device 9 in this embodiment in the lateral shifting of its fixation roller heating external belt 105. According to this flowchart, the control section 40 (controller) controls various portions of the fixing device 9, in order to control the fixing device 9 in the lateral shifting of the external heating belt 105.

As the fixing device 9 is put on standby in Step S1, the control section 40 drives the motor 125 to put the point of attachment (that is, sector gear 118) of the front end of the external heating unit holding frame 48 to the shaft 203, in its home position. That is, the control section 40 detects the position of the external heating unit holding frame 48 relative to the fixation roller 101, based on the output of the photo-interrupter 135 (Step S2).

As the heater control portion 140 receives the command issued by the control section 40 based on the outputs of the thermistors 121-124, it flows electric current through the halogen heaters 111-114 to heat the fixation roller 101, pressure roller 102, and heating belt supporting rollers 103 and 104. That is, the heater control portion 140 begins to adjust each of the rollers 101, 102, 103 and 104 in temperature (Step S3).

Then, as an image formation job is started (Yes in Step S4), the cam 205 is rotated by the unshown cam driving power source, whereby the external heating belt 105 is placed in contact with the fixation roller 101 (Step S5). Then, fixation roller 101 is rotated by the unshown fixation roller driving power source (Step S6), whereby the external heating belt 105 is rotated by the rotation of the fixation roller 101.

If the external heating belt 105 shifts frontward (direction indicated by arrow mark L in FIG. 4) of the fixation roller heating external unit 34 while it is circularly moved by the rotation of the fixation roller 101, the roller 128 which is in contact with the front edge of the external heating belt 105 is pushed by the external heating belt 105, causing thereby the sensor flag 132 to rotationally move, and block the light emitted by the light emitting portion of the photo-interrupter 133 (Yes in S7). Thus, the control section 40 issues a command to shift control portion 54 to make the belt shift control portion 54 to rotate the motor 125 in the direction to pivotally move the sector gear 118 so that the shaft 203 put through the elongated hole 115 of the sector gear 118 is moved to change the point of attachment of the heating unit 34 to the shaft 203 in order to cause the external heating belt 105 to shift rearward (direction indicated by arrow mark M in FIG. 4) (Step S8).

On the other hand, if the external heating belt 105 shifts rearward (direction indicated by arrow mark M in FIG. 4) of the external heating unit 34 while it is circularly moved by the rotation of the fixation roller 101, the roller 128 pivotally moves by being made to follow the external heating belt 105 by the resiliency of the pressure applying member 131, causing thereby the sensor flag 132 to rotationally move, and block the light emitted by the light emitting portion of the photo-interrupter 134 (Yes in S9). Thus, the control section 40 issues a command to the belt shift control portion 54 to make the belt shift control portion 54 rotate the motor 125 in the direction to pivotally move the sector gear 118 so that the shaft 203 put through the elongated hole 115 of the sector gear 118 is moved to move the point of attachment of the external heating unit holding frame 48 to the shaft 203, in order to cause the external heating belt 105 to shift frontward (direction indicated by arrow mark L in FIG. 4) (Step S10).

The above-described operation for controlling the external heating belt 105 in its lateral shift is continued till the end of the image formation job (Step S11).

As soon as the image formation job is completed (Yes in Step 11), the cam 205 which functions as the mechanism for moving the external heating belt 105 away from the fixation roller 101 is rotated by the cam driving power source. Thus, the external heating belt 105 retracts from the fixation roller 101 (Step S12). Then, in order to move the point of attachment of the external heating unit holding frame 48 to the shaft 203 (sector gear 118), to the home position, the control section 40 drives the motor 125 through the belt shift control portion (Step S13). Thus, the position of the external heating unit holding frame 48 relative to the fixation roller 101 is detected by the photo-interrupter 135.

As described above, this embodiment can minimize the external heating belt 105 in the lateral shift, that is, the shift in the direction parallel to the axial line of the fixation roller 101, by changing the angle of intersection between the external heating belt 105 and fixation roller 101 (±1.25°, in this embodiment) without changing the positional relationship between the heating belt supporting rollers 103 and 104, and the external heating belt 105, and therefore, can keep the external heating belt 105 more stable while it is circularly moved. Therefore, it can infallibly control the external heating belt 105 in unwanted lateral shift. In other words, this embodiment can prevent the pressure distribution between the external heating belt 105, and the heating belt supporting rollers 103 and 104, from becoming nonuniform. Therefore, it can keeps external heating belt 105 more uniform in its surface temperature in terms of its widthwise direction than any prior art.

Therefore, the external heating belt 105 is kept uniform, in terms of its widthwise direction, in the amount of the heat which it supplies to the fixation roller 101, being enabled to keep the fixation roller 101 more uniform in surface temperature, in terms of the lengthwise direction of the fixation roller 101. Therefore, the fixing device 9 in this embodiment is uniform and stable in the amount of heat it applies to a toner image (toner images0 on the sheet P of recording medium. Therefore, it is unlikely for the fixing device 9 (image forming apparatus 100) in this embodiment to output an image which is nonuniform in gloss, and/or an image which suffers from the like defects.

Embodiment 2

Figure 12:
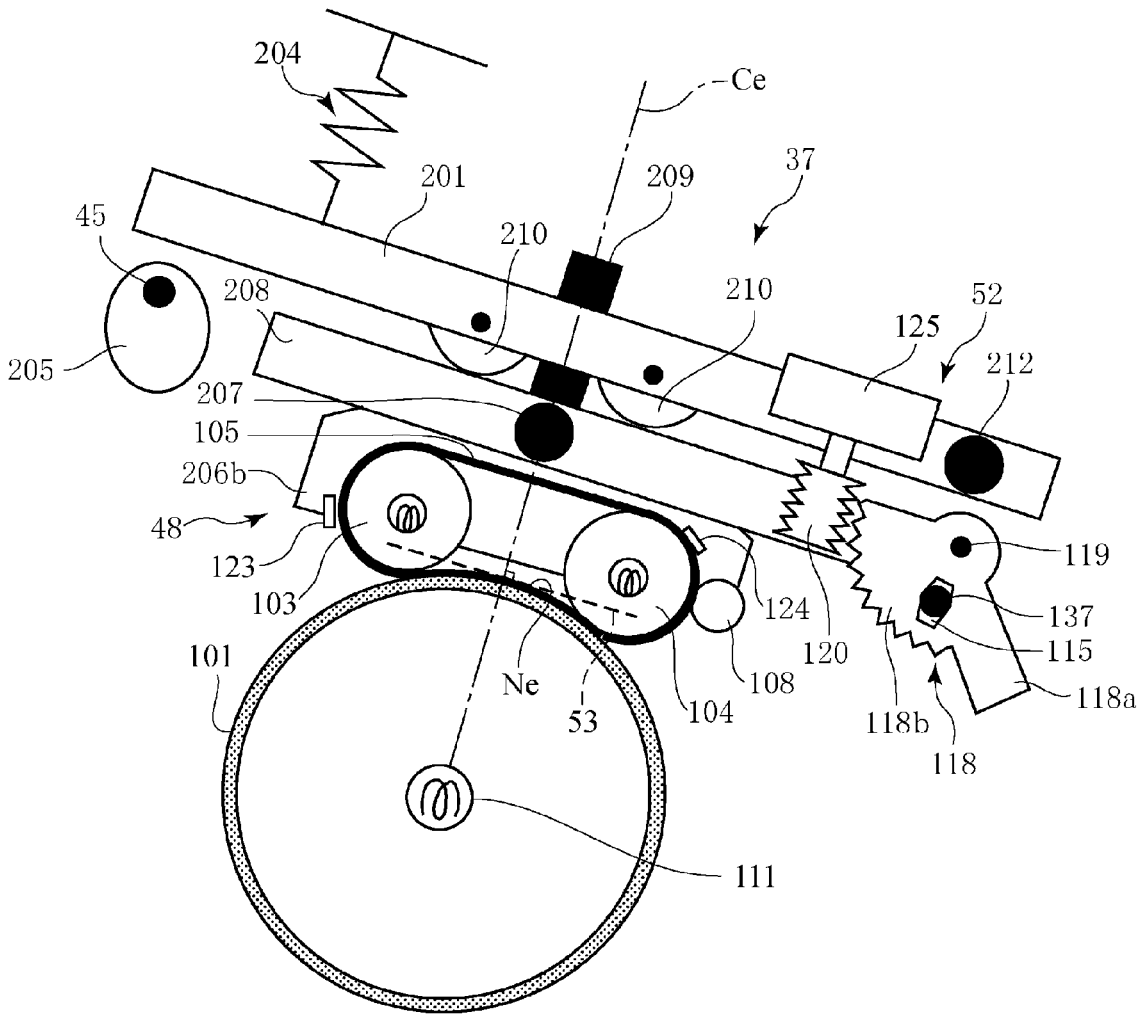
FIG. 12 is a schematic front view of the fixation roller heating external unit of the fixing device in the second embodiment. It shows the general structure of the unit.
Figure 13:
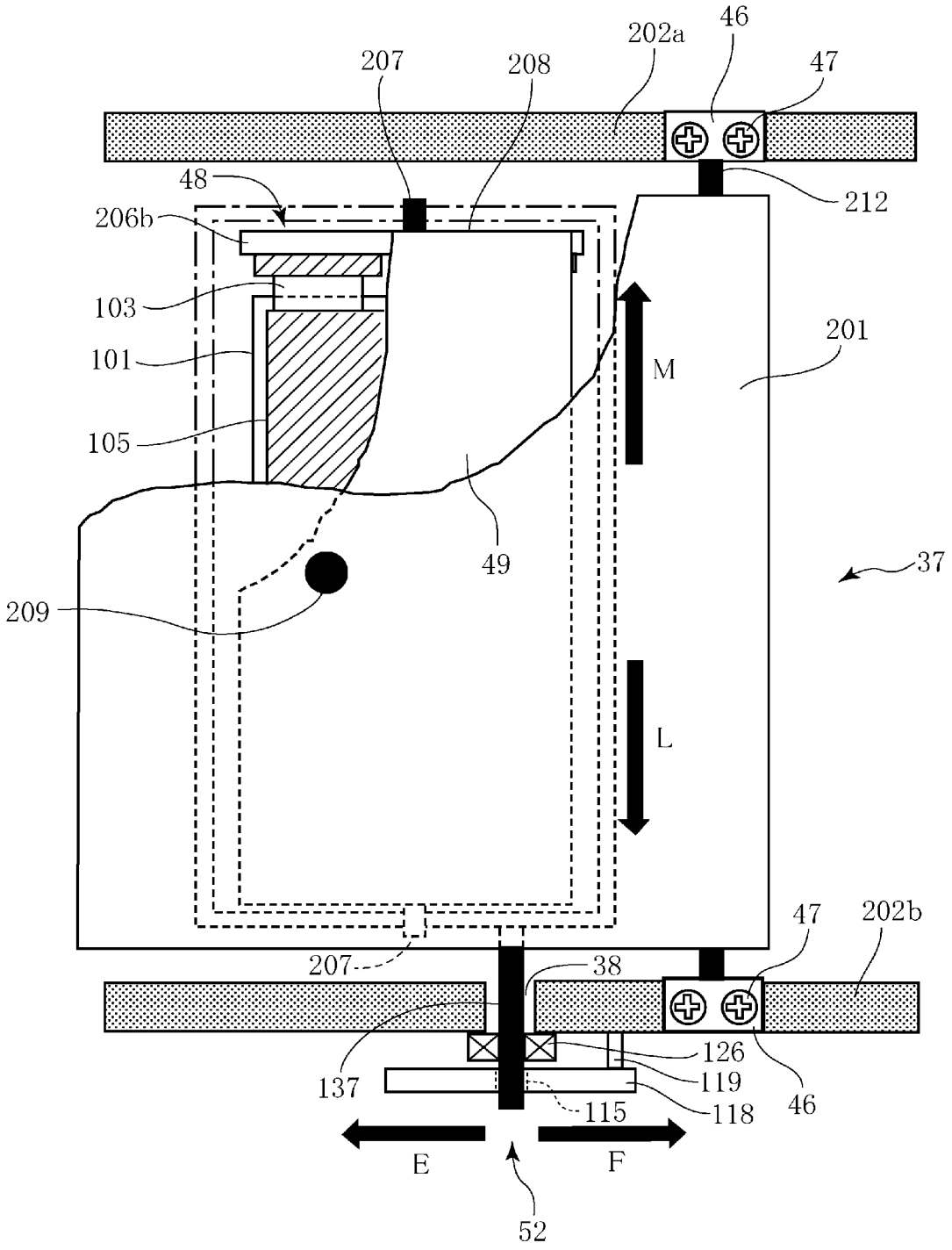
FIG. 13 is a plan view of the partially broken fixation roller heating external unit of the second embodiment, as seen from the direction perpendicular to the recording medium conveyance direction. It shows the general structure of the unit.

Next, referring to FIGS. 12 and 13, the second embodiment of the present invention is described. In the following description of the second embodiment, the components of the fixing device in this embodiment, which are the same in structure are given the same referential codes as those given to the counterparts in the first embodiment, and are not going to be described. FIG. 12 is a schematic sectional view of the fixing device equipped with the external heating belt in accordance with the present invention. It shows the general structure of the device. FIG. 3 is a plan view of the fixation roller heating external unit 37, as seen from the direction perpendicular to the lengthwise direction of the unit 37. It shows the general structure of the unit.

In the first embodiment, the external heating unit 34 was structured so that the angle of intersection between the external heating belt 105 and fixation roller 101 is changed by moving the point of attachment of one end of the external heating unit holding frame 48 to the shaft 203. Therefore, while the external heating belt 105 is controlled in lateral shift, the angle of intersection between the fixation roller 101 and external heating belt 105 (heating belt supporting rollers 103 and 104) changed, with the rear end of the external heating unit holding frame 48 (rear end of shaft 33 in FIG. 4) functioning as a pivot.

It has been confirmed that there is a relationship between the amount of pressure between the external heating belt 105 and fixation roller 101, and the amount by which the external heating belt 105 supplies heat to the fixation roller 101. That is, the greater the amount of pressure by which the external heating belt 105 is pressed upon the fixation roller 101, the tighter the contact between the external heating belt 105 and fixation roller 101, and therefore, the wider the nip Ne between the belt 105 and roller 101, and therefore, the greater the amount by which heat is supplied to the fixation roller 101 by the external heating belt 105. That is, it has been known that the greater the amount of pressure by which the external heating belt 105 is pressed upon the fixation roller 101, the greater the amount by which heat is supplied from the external heating belt 105 to the fixation roller 101. In other words, in the case of the fixing device 9, in the first embodiment, structured as described above, it is likely for the fixing device 9 to become nonuniform in the pressure applied to the fixation roller 101 by the heating belt supporting rollers 103 and 104, in terms of the lengthwise direction of the fixation roller 101; the front and rear sides of the fixing device 9 are likely to become different in the contact pressure between the belt supporting rollers 103 and 104, and the fixation roller 101.

Thus, in this embodiment, the fixing device 9 is structured so that the external heating unit holding frame 48 is rotationally supported by a holding frame supporting device, at the center in terms of the direction parallel to the rotational axis of the fixation roller 101. In other words, the fixing device 9 in this embodiment is structured so that the rotational axis Ce, which is the axis about which the external heating belt 105 and fixation roller 101 is pivotally moved relative to each other to change the angle of intersection between the external heating belt 105 and fixation roller 101, coincides with the rotational axis 209. That is, the external heating unit holding frame 48 is rotatably supported in such a manner that its pivot coincides with the center of the fixation roller 101 in terms of the direction parallel to the axial line of the fixation roller 101. Therefore, this embodiment is better than the first embodiment, in terms of the changes which occur to the front and rear sides of the fixing device 9 in the amount of pressure applied to the fixation roller 101 by the external heating belt 105 (belt supporting rollers 103 and 104), when the fixing device 9 is changed in the angle of intersection between the external heating belt 105 and fixation roller 101.

Thus, not only can this embodiment control the fixing device 9 in the lateral shifting of its external heating belt 105, but also, it can keep the fixing device 9 more uniform, in terms of the lengthwise direction of the fixation roller 101, in the amount of heat which the external heating belt 105 supplies to the fixation roller 101, than the first embodiment.

Next, the fixing device 9 in this embodiment, which is structured so that the rotational axis of the external heating unit holding frame 48 coincides with the center of the fixation roller heating external unit 37, is described in detail.

This embodiment is roughly the same as the first embodiment, in the structure of the external heating unit holding frame 48 for keeping the external heating belt 105 pressed upon the fixation roller 101. It is different from the first embodiment, only in that the fixing device 9 in this embodiment is structured as follows: The fixing device 9 is provided with a pressure applying frame 201, which is supported by the casing (external frame) of the fixing device 9 and functions as a device for supporting the external heating unit holding frame 48, and the external heating unit holding frame 48 is rotatable (pivotally movable) about the shaft 209 which is roughly vertical, being therefore movable relative to the pressure application frame 201.

More concretely, the heating belt supporting rollers 103 and 104 are rotatably supported by their lengthwise ends, by a pair of supporting members 206*a* and 206*b*, respectively, which are rotatably supported by a pair of shaft 207 and 207 attached to an intermediary rectangular frame 208 (as seen from above). Thus, the supporting members 206*a* and 206*b* are rotatable relative to the pressure application frame 201 about the shafts 207 and 207, at the lengthwise ends (top and bottom ends in FIG. 13) of the intermediary frame 208.

The external heating unit holding frame 48 supported by the intermediary frame 208 with the presence of the shafts 207 and 207 between itself and intermediary frame 208 rotatably holds the heating belt supporting rollers 103 and 104 by which the external heating belt 105 is suspended, between its belt supporting members 206*a* and 206*b*. Further, there is the cam 205 which is below the front end (left end in FIG. 12) of the pressure application frame 201 which is under the pressure from the pressing application section (member) 204. The cam 205 is supported by its shaft 45 so that it can be eccentrically rotated about the shaft 45.

The pressure application frame 201 is rotatably supported at its right end in terms of the left-right direction in FIG. 13, by the shafts 212 and 212, about which the pressure application frame 201 is rotationally movable. The shafts 212 and 212 are held to the lateral plates 202*a* and 202*b* of the external frame of the fixing device 9, with a pair of shaft holding members 47, which are solidly attached to the lateral plates 202*a* and 202*b*, with the use of screws 47. Further, the fixation roller heating external unit 37 is provided with a roughly vertical shaft 209 about which the external heating unit holding frame 48 is rotationally movable. More specifically, in terms of widthwise direction of external heating belt 105, the shaft 209 is put through roughly the center of the connective plate 49 which bridges between the belt supporting roller supporting members 206*a* and 206*b*. In terms of the direction in which the external heating belt 105 is circularly moved, the shaft 209 is on the left side of the connective plate 49.

Further, the belt shift control system (mechanism 52) is provided with two pairs of rollers 210 and 210, which are rotationally supported by the pressure application frame 201, in contact with the lengthwise ends (top and bottom ends), one for one, of the intermediary frame 208. In terms of the direction parallel to the circular movement of the external heating belt 105, the rollers 210 and 210 are located roughly in the middle of the pressure application frame 201. The pressure application frame 201 is fitted around the shaft 209 which extends from the bottom side of the pressure application frame 201 to the top side of the pressure application frame 201. Thus, the intermediary frame 208 is allowed to horizontally rotate about the shaft 209 while keeping a preset distance between itself and the pressure application frame 201.

The shaft 209, about which the external heating unit holding frame 48 rotationally moves, is attached to the intermediary frame 208 so that its axial line is parallel to the direction perpendicular to the tangential line 53 to the external nip Ne between the fixation roller 101 and external heating belt 105. In terms of the direction (top-to-bottom direction in FIG. 13) parallel to the axial line of the fixation roller 101, the shaft 209 is at the center of the fixation roller 101, being therefore at the center of the external heating belt 105. Thus, this embodiment can stabilize the fixing device 9 in the balance between the front and rear sides of the fixing device 9, in terms of the contact pressure between the fixation roller 101 and external heating belt 105.

The pressure application frame 201 is allowed to rotationally move about the shaft 212 and 212 supported between the lateral plates 202*a* and 202*b* of the external frame of the fixing device 9, and is kept pressured toward the fixation roller 101 by the pressure from the pressure applying section 204 (springs). Thus, as the cam 205 is rotated, the pressure application frame 201 is pivotally moved in such a manner that its front end moves upward or downward to make the external heating belt 105 come into contact with, or separated from, the fixation roller 101.

To reiterate, the fixation roller heating external unit 37 is held between the lateral plates 202*a* and 202*b* with a presence of a preset amount of clearance between the unit 37 and the lateral plates 202*a* and 202*b*. The external heating unit holding frame 48 has a shaft 137 which protrudes from one end (bottom end in FIG. 13) of the intermediary frame 208. More concretely, the shaft 137 is solidly attached to the intermediary frame 208 by one end, and is loosely put through the through hole 38 of the lateral plate 202*b* of the external frame of the fixing device 9, with the presence of a preset amount of gap between the shaft 137 and lateral plate 202*b*, that is, the diameter of the through hole 38 is greater than the external diameter of the shaft 137. Thus, the shaft 137 is allowed to move in the directions indicated by arrow marks E and F.

The end portion of the shaft 137, which is put through the through hole 38, is rotatably supported by the bearing 126, which is on the outward side of the lateral plate 202*b*. Further, it is put through the elongated hole 115 of the sector gear 118, which is on the outward side of the bearing 126. Thus, the shaft 137 is pivotally movable in such a manner that its end portion put through the through hole 38 moves along the edge of the elongated hole 38. Further, the sector gear 118 is supported as it is in the first embodiment. That is, it is pivotally supported by the shaft 119 attached to the outward side of the lateral plate 202*b*. Thus, the pivotal movement of the sector gear 118 (that is, angle of external heating unit holding frame 48 relative to fixation roller 101) can be detected with the use of the same method as that in the first embodiment.

The motor 125 is attached to the lateral plate 202*b*, being placed next to the sector gear 118. A worm gear 120 is solidly attached to the output shaft 125*a* of the motor 125. More specifically, the motor 125 is solidly attached to the lateral plate 202*b*, being positioned so that the worm gear 20 can be meshed with the toothed portion 118*b* of the sector gear 118*b*. In other words, the fixing device 9 in this embodiment is structured so that the external heating unit holding frame 48 is pivotally movable by the combination of the motor 125, worm gear 120, sector gear 118, shaft 137, etc.

In this embodiment, the combination of the belt shift control system (mechanism 52) and control section 40 makes up a fixing device adjusting means. The belt shift control system (mechanism 52) is the means for pivotally moving the external heating unit holding frame 48. The belt shift control portion 54 functions as the means for controlling the amount by which the external heating unit holding frame 48 is pivotally moved by the belt shift control system (mechanism 52).

The control sequence carried out by the control section 40 to control the external heating belt 105 in lateral shift is the same as that in the first embodiment. That is, the control section 40 pivotally moves the shaft 137 by driving the motor 125 to change the angle of the external heating unit holding frame 48 relative to the axial line of the fixation roller 101.

The effects obtainable by this embodiment are the same as those obtainable by the above-described first embodiment.

Figure 14:
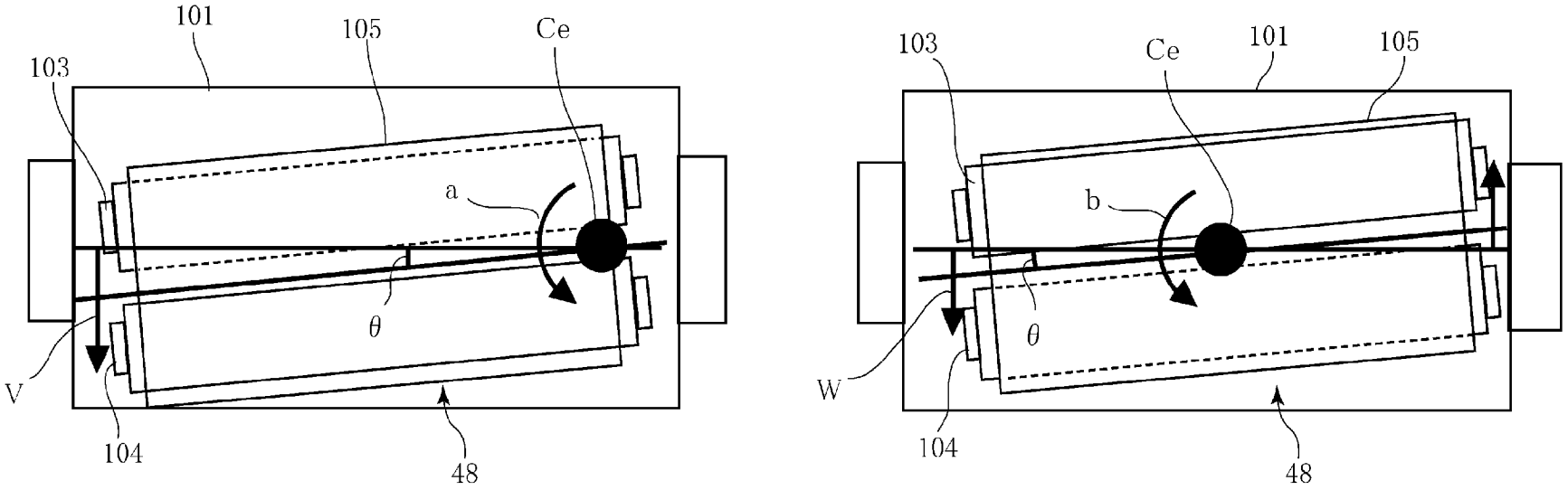
FIGS. 14(*a*) and 14(*b*) are plan views of the external heating unit supporting units in the first and second embodiments, respectively, as seen when the two units are the same in the angle of intersection between the fixation roller and external heating unit supporting unit.

Here, referring to FIGS. 14(*a*) and 14(*b*), a case in which the angle of intersection between the external heating belt supporting rollers 103 and 104, and fixation roller 101 is set to an angle θ in order to control the lateral shift of the external heating belt 105 of the fixing device 9 structured as in the first or second embodiments is described. The arrow marks a and b in FIGS. 14(*a*) and 14(*b*) indicate the directions in which the belt supporting rollers 103 and 104 are pivotally moved about the rotational axis C3, and the arrow marks V and W indicate the amount by which the two rollers 103 and 104 are pivotally moved about the rotational axis Ce.

In the first embodiment, in order to allow the external heating unit holding frame 48 to pivotally move in such a manner that the angle of intersection between the external heating belt supporting rollers 103 and 104, and the fixation roller 101 changes, the external heating unit holding frame 48 of the fixation roller heating external unit 34 is attached by one end (rear end) to the shaft 203 which is pivotally attached to the rear plate of the external frame of the fixing device 9. Therefore, it was likely for the external heating belt supporting rollers 103 and 104 to deviate in position from the fixation roller 101 on their front side, in terms of their lengthwise direction, than on their rear side.

In comparison, in the second embodiment, the fixation roller heating external unit 37 is provided with the intermediary frame 208, by which the pressure application frame 201 directly supported by the lateral plates 202*a* and 202*b* of the external frame of the fixing device 9, is separated from the external heating unit holding frame 48 which is pivotally movable relative to the fixation roller 101. Further, in terms of the lengthwise direction of the external heating unit holding frame 48 (top-bottom direction in FIG. 13), the shaft 209 which functions as the rotational axis Ce about which the external heating belt 105 rotates is at the center of the external heating unit holding frame 48. Therefore, in a case where the angle θ of intersection between the external heating unit holding frame 48 and fixation roller 101 in the second embodiment is set as it is set in the first embodiment, the amount by which the front end (and rear end) of the external heating unit holding frame 48 moves relative to the fixation roller 101 when the external heating belt 105 is controlled in its lateral shift is a half of that in the first embodiment, as shown in FIGS. 14(*a*) and 14(*b*).

Further, the front and rear sides of the heating belt supporting rollers 103 and 104 in terms of their lengthwise direction are the same in the amount by which they are moved when the external heating belt 105 is controlled in lateral shift. Therefore, the front and rear sides of the heating belt supporting rollers 103 and 104 become the same in the amount of pressure applied to the fixation roller 101 by the rollers 103 and 104. Therefore, the fixing device 9 in the second embodiment is more uniform in terms of the lengthwise direction of the fixation roller 101, in the amount of heat supplied to the fixation roller 101 by the external heating belt 105, being therefore more uniform in the amount of heat which the fixation roller 101 gives to a sheet of recording medium and the toner image(s) thereon, than the fixing device 9 in the first embodiment. Therefore, the images outputted by an image forming apparatus employing the fixing device 9 in the second embodiment suffer far less from the image defects, more specifically, the nonuniformity in the gloss attributable to the fixing device, than an image forming apparatus employing the fixing device 9 in the first embodiment.

Embodiment 3

Figure 15:
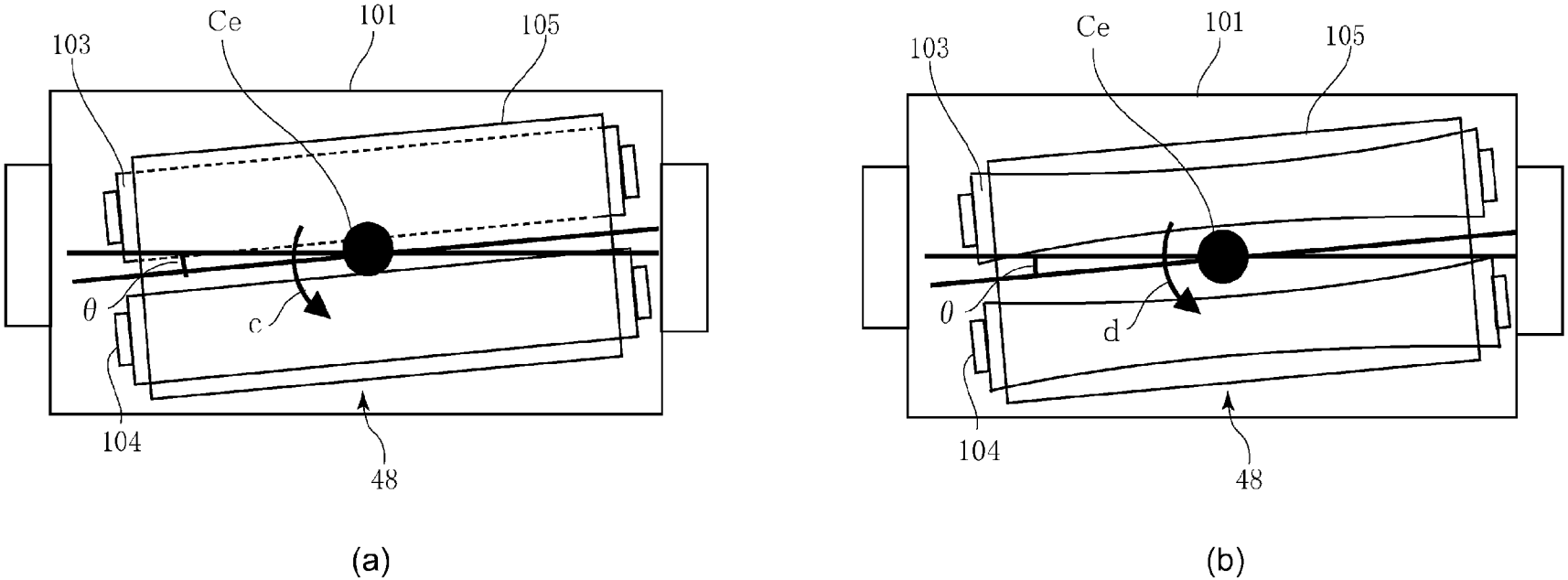
FIGS. 15(*a*) and 15(*b*) are plan views of the external heating unit supporting units in the second and third embodiments, respectively, as seen when the two units are the same in the angle of intersection between the fixation roller and external heating unit supporting unit.

Next, referring to FIG. 15, the third embodiment of the present invention is described. The components of the fixing device 9 in this embodiment, which are the same in structure as the counterparts in the first and second embodiments, are given the same referential codes as those given to the counterparts, and are not going to be described here. FIGS. 15(*a*) and 15(*b*) are plan views of the fixation roller heating external units in the second and third embodiments, in a case where the two units are made the same in the angle of intersection between the external heating belt 105 and fixation roller 101 in order to compare the two embodiments.

In this embodiment, the fixation roller heating external unit (34, 37) is structured so that it becomes more uniform in terms of the lengthwise direction of the fixation roller 101, in the amount of pressure applied to the fixation roller 101 by the external heating belt supporting rollers 103 and 104, than the fixation roller heating external unit 37 in the second embodiment. More specifically, in this embodiment, the rollers 103 and 104 by which the external heating belt 105 is suspended are given such an overall contour that makes the rollers 103 and 104 nonuniform in diameter in terms of their lengthwise direction; they are formed so that they gradually reduce in diameter toward their center starting from their lengthwise end, in terms of the lengthwise direction of the rollers; in their sectional view at the plane which coincides with their axial line, their peripheral surface are concave.

In this embodiment, the diameter of the center of each of the belt supporting rollers 103 and 104, and the diameter of the lengthwise ends of the rollers 103 and 104, are set according to the angle of intersection will be between the fixation roller 101 and external heating unit holding frame 48 during the operation for controlling the external heating belt 105 in lateral shift. In terms of the structure of the fixation roller heating external unit and the method for controlling the external heating belt 105 in lateral shift, this embodiment is the same as the first and second embodiment.

FIGS. 15(*a*) and 15(*b*) shows the fixation roller heating external units 34 and 37 in the first and second embodiments, respectively, as seen when the angle of intersection between the fixation roller 101 and external heating unit holding frame 48 is set to an angle θ in order to control the external heating belt 105 in lateral shift. The arrow marks c and d in the drawings indicate the direction in which the external heating belt supporting rollers 103 and 104 are pivotally moved about the rotational axis Ce, respectively.

Referring to FIG. 15(*a*), in the second embodiment, the belt supporting rollers 103 and 104 are uniform in diameter in terms of their lengthwise direction. Therefore, as the rollers 103 and 104 (external heating unit holding frame 48) are angled relative to the fixation roller 101, the amount by which the lengthwise ends of each of the rollers 103 and 104 rotationally move about the lengthwise center of the rollers 103 and 104 is relatively large. In other words, the amount by which the lengthwise ends of the rollers 103 and 104 move away from the corresponding lengthwise ends of the fixation roller 101 is substantial, making the fixation roller 101 nonuniform in the amount of pressure applied to the fixation roller 101 by the belt supporting rollers 103 and 104, in terms of the lengthwise direction of the fixation roller 101(making lengthwise ends of fixation roller 101 different in amount of pressure applied to fixation roller 101 by belt supporting rollers 103 and 104, from center of fixation roller 101).

In comparison, in the third embodiment, the belt supporting rollers 103 and 104 are shaped so that as they are seen from the direction perpendicular their axial lines, they are concave. Therefore, even as the rollers 103 and 104 are tilted relative to the fixation roller 101 in such a manner that the angle of intersection between the roller 103 (104) and the fixation roller 101 becomes an angle θ, the lengthwise ends of the roller 103 (104) remain tightly pressed upon the fixation roller 101. Thus, this embodiment can keep the fixing device 9 more uniform in terms of the lengthwise direction of the fixation roller 101, in the amount of pressure applied to the fixation roller 101 by the roller 103 (104), than the first and second embodiment.

The more uniform the fixation roller 101 in terms of its lengthwise direction, in the amount of heat given thereto by the external heating belt 105, the more uniform the fixation roller 101 in terms of its lengthwise direction, in the surface temperature, and therefore, the more uniform, the fixation roller 101 in terms of its lengthwise direction, in the amount of heat its gives to a sheet of recording medium and the toner image(s) thereon. Thus, an image forming apparatus employing the fixing device 9 in this embodiment can output images which suffer far less from the defects, in particular, the non-uniformity in gloss than those outputted by an image forming apparatus employing the fixing device 9 in the first or second embodiments.

In other words, this embodiment is more effective to minimize the problem that as the belt supporting rollers 103 and 104 are tilted relative to the fixation roller 101 at an angle of θ in order to control the external heating belt 105 in lateral shift, the lengthwise end portions of the fixation roller 101 become smaller in the amount of the pressure applied to the fixation roller 101 by the rollers 103 and 104 than the center of the fixation roller 101. Thus, it can keep the fixing device 9 more uniform in its lengthwise direction, in the distribution of the pressure applied to the fixation roller 101 by the rollers 103 and 104, and therefore, can keep the fixing device 9 uniform in the amount of the heat supplied to the fixation roller 101 by the external heating belt 105, than the first and second embodiments.

In this (third) embodiment, the belt supporting rollers 103 and 104 are shaped so that as they are seen from the direction perpendicular to their axial lines, they are concave. However, this embodiment is not intended to limit the present invention in the shape of the belt supporting roller 103 (104). For example, the present invention is also applicable to a fixing device, only one of the belt supporting rollers 103 and 104 of which is shaped so that its peripheral surface concaves. The effects of the application of the present invention to such a fixing device are roughly the same as those obtainable by this (third) embodiment.

At this time, referring to FIG. 16, the results of the experiment carried out to compare the first, second, and third embodiments are described. In the experiment, the total amount of load (pressure) applied to the fixation roller 101 by the external heating belt 105 was pressed upon the fixation roller 101 was set to 10 kgf. The recording medium was sheets of coated paper which were A3 in size and 300 g in basis weight. FIG. 16 shows the lowest temperatures of the peripheral surface of each of the fixation rollers 101 in the first, second, and third embodiments, measured at the front end, center, and rear end of each fixation roller 101 immediately after 50 sheets of coated paper were conveyed through the fixing device 9.

As will be evident from FIG. 16, in the first embodiment, the pivot of the fixation roller heating external unit (fixation roller heating external belt unit) was at one end of the unit in terms of the lengthwise direction of the fixing device 9. In the second embodiment, it was at the center of the unit. In the third embodiment, it was also at the center of the unit. As for the contour of the belt supporting rollers 103 and 104, the rollers 103 and 104 in the first and second embodiments were uniform in diameter in terms of their lengthwise direction. The rollers 103 and 104 in the third embodiment were shaped so that their peripheral surface concave.

The fixing devices 9 in the first, second and third embodiments were set up so that the contact pressure between the rollers 103 (104) and fixation roller 101 became 100% at the center of the fixation nip Ne in terms of the lengthwise direction of the fixation roller 101. In the case of the fixing device 9 in the first embodiment, the lowest temperatures at the front end, center, and rear end of the peripheral surface of the fixation roller 101 in terms of the lengthwise direction of the fixation roller 101 were 166.8° C., 167.9° C. and 170.2° C., respectively. In the case of the fixing device 9 in the second embodiment, they were 168.0° C., 168.5° C. and 168.0° C., respectively. In the case of the fixing device 9 in the third embodiment, they were 168.3° C., 168.3° C. and 168.3° C., respectively.

It is evident from the results of the above described experiment that the fixing device 9 in the second embodiment is more uniform in the surface temperature of the fixation roller 101, and smaller in the difference in the peripheral temperature between the front and rear sides of the fixation roller 101, than the fixing device 9 in the first embodiment. It is also evident from the results of the above described experiment that in the case of the fixing device 9 in the third embodiment, there was no difference in the surface temperature of the fixation roller 101 between the front and rear ends of the fixing device 9, whereas in the case of the fixing device 9 in the second embodiment, there was still a small amount of difference in surface temperature of the fixation roller 101 between the front and rear ends of the fixation roller 101. That is, the former is more uniform in surface temperature of the fixation roller 101 than the latter.

In the first to third embodiments of the present invention described above, the rotational heating member of the fixing device, which is to be heated by the external heating belt, was the fixation roller. However, the present invention is also applicable to a fixing device which employs a fixation belt.

Also in the first to third embodiments, the fixing devices employed the external heating belt. However, the present invention is also applicable to a fixing device structured as follows. For example, the present invention is applicable to a fixing device, the pressure applying member of which is a pressure application belt supported by a pair of belt supporting rollers, and which is structured so that the pressure application belt is rotated by the rotation of the fixation roller, and also, so that the pair of belt supporting rollers are rotationally (pivotally) movable about a preset axis to be tilted together relative to the direction of the generatrix of the peripheral surface of the fixation roller (axial line of fixation roller). That is, the present invention is applicable to the mechanism (system) for controlling the pressure application belt in lateral shift.

Further, in the first to third embodiments described above, it was to an image heating device (fixing device) that the present invention was applied. However, the present invention is also applicable to an image forming apparatus which employs an intermediary transfer member, which is in the form of an endless belt, supported by a pair of belt supporting rollers, and rotated by the rotation of the photosensitive member of the apparatus, and which is structured so that the two rollers are tilted together relative to the direction of the generatrix of the peripheral surface of the photosensitive member. In such a case, the present invention is applicable as a mechanism (system) for controlling the intermediary transfer belt in lateral shift. In addition, the present invention is also applicable to an image forming apparatus which employs an endless belt supported by a pair of belt supporting rollers and circularly moved by a belt driving rotational member. In such a case, the image forming apparatus is structured so that the pair of rollers by which the endless belt is suspended (supported) can be tilted together relative to the direction of the generatrix of the peripheral surface of the belt driving rotational member (axial line of belt driving rotational member).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 029191/2012 filed Feb. 14, 2012, which is hereby incorporated by reference.

What is claimed is:

1. An image heating apparatus comprising:

a heating rotatable member configured to heat a toner image on a sheet;

a belt unit including an endless belt configured to heat said heating rotatable member by contacting an outer surface of said heating rotatable member, and a plurality of supporting members configured to rotatably support an inner surface of said endless belt;

a detector configured to detect that said endless belt is out of a predetermined zone in a widthwise direction of said endless belt; and a tilting mechanism configured to tilt said belt unit in a direction of causing said endless belt to return into the predetermined zone based on an output of said detector.

2. An apparatus according to claim 1, further comprising a driving mechanism configured to rotate said heating rotatable member, wherein said endless belt is rotated by a force received by said heating rotatable member.

3. An apparatus according to claim 1, wherein said supporting members each include a roller configured to rotatably support the inner surface of said endless belt.

4. An apparatus according to claim 3, wherein at least one of said rollers each include a heater therein.

5. An apparatus according to claim 1, further comprising a moving mechanism configured to move said belt unit between a position in which said endless belt contacts said heating rotatable member and a position in which said endless belt is spaced from said heating rotatable member.

6. An apparatus according to claim 1, wherein said detector is disposed at one widthwise end portion of said endless belt.

7. An apparatus according to claim 6, further comprising another detector provided at the other widthwise end portion of said endless belt and configured to detect that said endless belt is out of the predetermined zone in the widthwise direction.

8. An apparatus according to claim 1, wherein said heating rotatable member includes a heating roller.

9. An apparatus according to claim 1, further comprising a nip forming member cooperating with said heating rotatable member to form a nip for nipping and feeding the sheet.

10. An image heating apparatus comprising:

a heating rotatable member configured to heat a toner image on a sheet;

a belt unit including an endless belt configured to heat said heating rotatable member by contacting an outer surface of said heating rotatable member, and two supporting rollers configured to rotatably support said endless belt and press contact said endless belt to said heating rotatable member;

a detector configured to detect a position of said endless belt in a widthwise direction of said endless belt; and a tilting mechanism configured to tilt said belt unit in a direction of causing said endless belt to return into the predetermined zone based on an output of said detector.

11. An apparatus according to claim 10, further comprising a driving mechanism configure to rotate said heating rotatable member, wherein said endless belt is rotated by a force received by said heating rotatable member.

12. An apparatus according to claim 11, wherein said two supporting rollers are rotated by a force received by said endless belt.

13. An apparatus according to claim 12, wherein said two supporting rollers each include a heater therein.

14. An apparatus according to claim 10, further comprising a moving mechanism configured to move said belt unit between a position in which said endless belt contacts said heating rotatable member and a position in which said endless belt is spaced from said heating rotatable member.

15. An apparatus according to claim 10, wherein said detector is disposed at one widthwise end portion of said endless belt.

16. An apparatus according to claim 15, further comprising another detector provided at the other widthwise end portion of said endless belt and configured to detect that said endless belt is out of the predetermined zone in the widthwise direction.

17. An apparatus according to claim 10, wherein said heating rotatable member includes a heating roller.

18. An apparatus according to claim 10, further comprising a nip forming member cooperating with said heating rotatable member to form a nip for nipping and feeding the sheet.

19. An image heating apparatus comprising:

a heating rotatable member configured to heat a toner image on a sheet;

an endless belt configured to heat said heating rotatable member by contacting an outer surface of said heating rotatable member;

two supporting rollers configured to rotatably support an inner surface of said endless belt;

a holding mechanism configured to hold said endless belt and said two supporting rollers;

a detector configured to detect a position of said endless belt in a widthwise direction of said endless belt; and a swing mechanism configured to swing, based on an output of detector, said holding mechanism so that an axis of each of said two supporting rollers, which press contact said endless belt to said heating rotatable member, crosses a generatrix of said heating rotatable member.

20. An apparatus according to claim 19, further comprising a swing shaft provided at a position remote from said heating rotatable member with respect to said endless belt and extending substantially parallel with a normal line direction of a surface of said endless belt, which is between said two supporting rollers, wherein said swing mechanism swings said holding mechanism about said swing shaft based on the output of said detector.

21. An apparatus according to claim 20, wherein said detector detects that said endless belt is out of a predetermined zone in the widthwise direction, and said swing mechanism rotates said holding device in a direction of returning said endless belt into the predetermined zone based on the output of said detector.

22. An apparatus according to claim 19, further comprising a driving mechanism configured to rotate said heating rotatable member, wherein said endless belt is rotated by a force received by said heating rotatable member, and said two supporting rollers are rotated by a force received by said endless belt.

23. An apparatus according to claim 22, wherein said two supporting rollers each include a heater therein.

24. An apparatus according to claim 19, further comprising a moving mechanism configured to move said belt unit between a position in which said endless belt contacts said heating rotatable member and a position in which said endless belt is spaced from said heating rotatable member.

25. An apparatus according to claim 19, wherein said detector is disposed at one widthwise end portion of said endless belt.

26. An apparatus according to claim 25, further comprising another detector provided at the other widthwise end portion of said endless belt and configured to detect that said endless belt is out of the predetermined zone in the widthwise direction.

27. An apparatus according to claim 19, wherein said heating rotatable member includes a heating roller.

28. An apparatus according to claim 19, further comprising a nip forming member cooperating with said heating rotatable member to form a nip for nipping and feeding the sheet.

29. An image forming apparatus comprising:

a belt unit including an endless belt and a plurality of supporting members configured to rotatably support said endless belt;

a driving rotatable member configured to rotationally drive said endless belt by contacting an outer surface of said endless belt;

a detector configured to detect that said endless belt is out of a predetermined zone in a widthwise direction; and a tilting mechanism configured to tilt said belt unit in a direction of causing said endless belt to return into the predetermined zone based on an output of said detector.

30. An image forming apparatus comprising:

a belt unit including an endless belt and two supporting rollers rotatably supporting an inner surface of said endless belt;

a driving rotatable member configured to rotationally drive said endless belt by contacting an outer surface of the endless belt;

a detector configured to detect that said endless belt is out of a predetermined zone in a widthwise direction of said endless belt; and a tilting mechanism configured to tilt in a direction of causing said belt unit to return into the predetermined zone based on an output of said detector.

31. An image forming apparatus comprising:

an endless belt;

two supporting rollers configured to rotatably support an inner surface of said endless belt;

a driving rotatable member configured to rotationally drive said endless belt by contacting an outer surface of said endless belt;

a holding mechanism configured to hold said endless belt and said two supporting rollers;

a detector configured to detect a position of said endless belt in a widthwise direction of said endless belt; and a swing mechanism configured to swing, based on an output of said detector, said holding mechanism so that an axial direction of each of said two supporting rollers, which press contact said endless belt to said driving rotatable member, crosses a generatrix of said driving rotatable member.

32. An apparatus according to claim 31, further comprising a swing shaft provided at a position remote from said driving rotatable member with respect to said endless belt and extending substantially parallel with a normal line direction of a surface of said endless belt, which is between said two supporting rollers, wherein said swing mechanism swings said holding mechanism about said swing shaft based on the output of said detector.

33. An apparatus according to claim 32, wherein said detector detects that said endless belt is out of a predetermined zone in the widthwise direction, and said swing mechanism rotates said holding mechanism in a direction of causing said endless belt to return into the predetermined zone based on the output of said detector.

34. An image heating apparatus comprising:

a heating rotatable member configured to heat a toner image on a sheet;

a belt unit including an endless belt configured to heat said heating rotatable member by contacting an outer surface of said heating rotatable member, and two supporting rollers configured to rotatably support an inner surface of said endless belt and press contact said endless belt to said heating rotatable member;

a detector configured to detect that said endless belt is out of a predetermined zone in a widthwise direction of said endless belt; and a shaft portion provided at a position remote from said heating rotatable member with respect to said endless belt and extending substantially in parallel with a normal line direction of a surface, of said endless belt, which is between said two supporting rollers; and a rotating mechanism configured to rotate said belt unit about said shaft portion in a direction of causing said endless belt to return into the predetermined zone based on an output of said detector.

35. An apparatus according to claim 34, further comprising a driving mechanism configured to rotate said heating rotatable member, wherein said endless belt is rotated by a force received by said heating rotatable member.

36. An apparatus according to claim 34, wherein said two supporting rollers each include a heater therein.

37. An apparatus according to claim 34, further comprising a moving mechanism configured to move said belt unit between a position in which said endless belt contacts said heating rotatable member and a position in which said endless belt is spaced from said heating rotatable member.

38. An apparatus according to claim 34, wherein said detector is disposed at one widthwise end portion of said endless belt.

39. An apparatus according to claim 38, further comprising another detector provided at the other widthwise end portion of said endless belt and configured to detect that said endless belt is out of the predetermined zone in the widthwise direction.

40. An apparatus according to claim 34, wherein said heating rotatable member includes a heating roller.

41. An apparatus according to claim 34, further comprising a nip forming member cooperating with said heating rotatable member to form a nip for nipping and feeding the sheet.

42. An image forming apparatus comprising:

a belt unit including an endless belt, and two supporting rollers configured to rotatably support an inner surface of said endless belt;

a driving rotatable member configured to rotationally drive said endless belt by contacting an outer surface of said endless belt;

a detector configured to detect a position of said endless belt in a widthwise direction of said endless belt;

a shaft portion provided at a position remote from said driving rotatable member with respect to said endless belt and extending substantially in parallel with a normal line direction of a surface, of said endless belt, which is between said two supporting rollers; and a rotating mechanism configured to rotate said belt unit about said shaft portion in a direction of causing said endless belt to return into a predetermined zone based on an output of said detector.

43. An apparatus according to claim 42, further comprising a driving mechanism configured to rotate said driving rotatable member, wherein said endless belt is rotated by a force received by said driving rotatable member.

44. An apparatus according to claim 42, wherein said detector is disposed at one widthwise end portion of said endless belt.

45. An apparatus according to claim 44, further comprising another detector provided at the other widthwise end portion of said endless belt and configured to detect that said endless belt is out of the predetermined zone in the widthwise direction.

* * * * *